US006257116B1

(12) United States Patent
Moczijdlower et al.

(10) Patent No.: US 6,257,116 B1
(45) Date of Patent: Jul. 10, 2001

(54) PISTOL

(75) Inventors: Jacob L. Moczijdlower; Vera R. Pini Leitao, both of Rio de Janeiro (BR); Luiz M. Vianna Camargo, Rua Cosme Velho, 318 - Bi. 1, Cob. - Cosme Velho, Rio de Janeiro (BR), 22241-090

(73) Assignee: Luiz M. Vianna Camargo (BR)

( * ) Notice: Subject to any disclaimer, the term of this patent is extended or adjusted under 35 U.S.C. 154(b) by 0 days.

(21) Appl. No.: 09/361,113

(22) Filed: Jul. 27, 1999

(51) Int. Cl.[7] ..... F41A 5/00

(52) U.S. Cl. ..... 89/155; 89/156; 89/184; 42/38; 42/39; 42/26

(58) Field of Search ..... 89/140, 155, 156, 89/184; 42/26, 27, 38, 39

(56) References Cited

U.S. PATENT DOCUMENTS

| | | | | |
|---|---|---|---|---|
| 2,087,661 | * | 7/1937 | Bretton | 42/38 |
| 3,967,402 | * | 7/1976 | Cooksey | 42/38 |
| 4,569,270 | * | 2/1986 | Timari | 89/184 |
| 4,976,184 | | 12/1990 | Bunczk | 89/14.3 |
| 5,404,790 | | 4/1995 | Averbukh | 89/193 |
| 5,410,831 | | 5/1995 | Felk | 42/25 |
| 5,426,880 | | 6/1995 | Ruger et al. | 42/69.03 |
| 5,465,645 | | 11/1995 | Cominolli | 89/198 |
| 5,549,030 | | 8/1996 | Lespron | 89/14.3 |
| 5,654,519 | | 8/1997 | Albrecht et al. | 89/163 |
| 5,675,924 | * | 10/1997 | Predazzer | 89/155 |
| 6,112,636 | * | 9/2000 | Besselink | 89/184 |

* cited by examiner

*Primary Examiner*—J. Woodrow Eldred
(74) *Attorney, Agent, or Firm*—Nixon & Vanderhye P.C.

(57) ABSTRACT

A slide action pistol including a frame; a barrel supported on said frame and having a bore on an axis of the barrel; a handgrip portion of the frame provided with a cavity therein for receiving a magazine; a firing assembly including a trigger, hammer and firing pin arranged in operative relationship; and, a slide having one end engaged with the barrel and an opposite end pivotally connected to the handgrip portion, the slide arranged to pivot upwardly and rearwardly when the pistol is fired.

33 Claims, 39 Drawing Sheets

Fig. 27
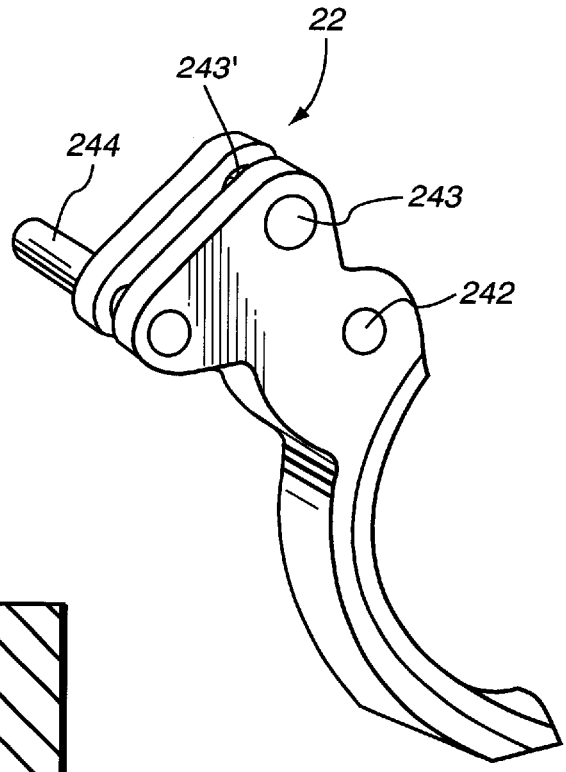
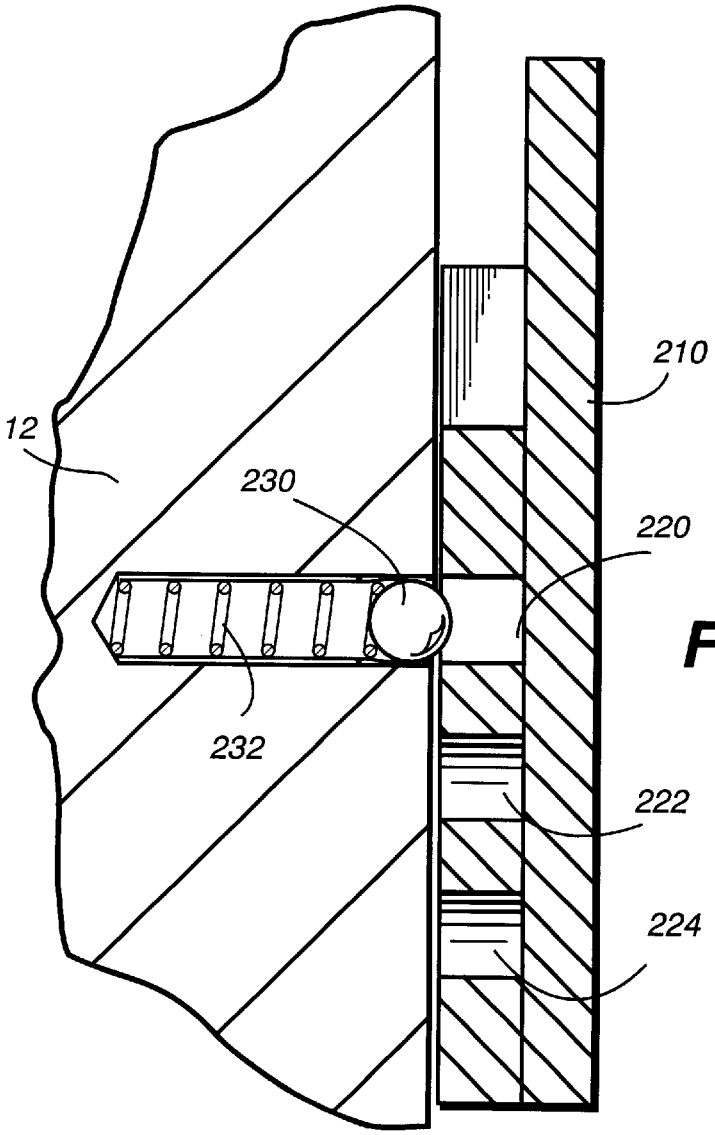
Fig. 26

PISTOL

TECHNICAL FIELD

This invention relates to a pistol construction having semi-automatic and full automatic firing modes.

BACKGROUND AND SUMMARY OF THE INVENTION

Semi-automatic and automatic pistols are well represented in the patent literature. Examples may be found in U.S. Pat. Nos. 5,654,519 and 5,717,156.

A common problem with such pistols is the reaction or recoil force experienced by the user when the pistol is fired. More specifically, the firing action/reaction creates a force moment couple which drives the pistol rearwardly and upwardly. The problem is particularly acute in automatic pistols where multiple rounds are fired per second. Attempts have been made to solve this problem by incorporating recoil compensation devices, usually added to the muzzle of the pistol. See, for example, U.S. Pat. Nos. 4,976,184 and 5,549,030.

Other persistent problems with semi-automatic and automatic pistols relate to difficulty encountered in changing barrels, field stripping for cleaning, and the like.

The present invention seeks to alleviate the above mentioned problems through the incorporation of several unique features. For example, the pistol in accordance with this invention is provided with a rotatable slide, unlike the axially reciprocable slides typically used. The slide is arranged to rotate (upwardly and rearwardly about a pivot axis located at the lower end of the grip) when the pistol is fired, the upward pivoting movement creating a downward reaction force, thus substantially balancing the recoil forces.

Another unique feature is a fast and easy barrel changing configuration, which does not require removal of the slide. This feature enables the user to change the barrel quickly, for example, for a longer or silenced barrel. The barrel itself is secured to the pistol frame by a tongue and groove keying arrangement, with a readily accessible lever connected to a rotating lock mechanism. This feature is coupled with an associated safety mechanism which prevents the pistol from being fired when the barrel is absent and/or when the locking mechanism is in the open position. The barrel per se is spaced from the frame along a portion of the length thereof, creating an air space which advantageously cools the barrel.

Another feature relates to quick and safe field stripping which allows easy removal of the magazine and slide without having to remove the barrel, and without having to liberate or release any springs or other small parts.

Another feature of the invention relates to the incorporation of a conventional laser aiming system into the pistol frame, which can be operated without moving the trigger finger from within the trigger guard, and without any barrel deviation. The latter occur in conventional configurations where operation requires the action of finger(s) other than the one operating the trigger. To achieve this end, the laser aiming device is integrated into the frame forward of the trigger guard, just below the barrel. The laser actuator button is located within the perimeter of the trigger guard.

It is another feature of the invention to provide a safety lever which is movable between locked, semi-automatic mode and full automatic modes. Thus, the safety lever acts in concert with a trigger actuator bar operatively connected between the trigger, the hammer, and an associated sear mechanism which allows the hammer to be cocked and released via its interaction with the hammer. The trigger bar is operable for a single shot or multiple successive shots in the semi-automatic firing mode, while a separate sear bar actuator, inoperable during the single shot and semi-automatic mode, is operable in the full automatic mode via interaction with the sear mechanism and the slide to effect continuous firing with the trigger held in the firing position.

It is another feature of the invention that the recoil spring which returns the slide to its normal closed position after firing, and the hammer spring which drives the hammer into engagement with the firing pin are interrelated in a unique manner. Specifically, the hammer spring guide rod moves into and out of the recoil spring guide in telescoping fashion, thus providing a compact arrangement of parts which can be left undisturbed during barrel removal/assembly, field stripping, and/or magazine removal and insertion.

Another feature of the invention relates to ambidextrous operation in the sense that the safety lever, slide release lever and barrel release lever can be accessed easily from either side of the pistol.

It is a further feature of the invention to provide a cartridge extractor which is raised out of the plane of the frame when a cartridge is chambered, thereby giving the user a safe indication, even in total darkness, that the gun is ready to be fired. The extractor works in combination with a fixed ejector which throws empty cartridge casings upwardly, slightly forwardly and to one side of the pistol.

Still another feature of the invention relates to the use of plastic or similar bearings or inserts to aid in reducing noise associated with movement of the slide.

Accordingly, in its broader aspects, the present invention relates to a slide action pistol including a frame; a barrel supported on the frame and having a bore on an axis of the barrel; a handgrip portion of the frame provided with a chamber therein for receiving a magazine; a firing assembly including a trigger, hammer and firing pin arranged in operative relationship; and, a slide having one end engaged with the barrel and an opposite end pivotally connected to the handgrip, the slide arranged to pivot upwardly and rearwardly when the pistol is fired.

In another aspect, the invention relates to a slide action pistol including a frame; a barrel supported on the frame and having a bore on an axis of the barrel; a movable slide mounted in the frame; a handgrip portion of the frame provided with a chamber therein for receiving a magazine; a firing assembly including a trigger, hammer and firing pin arranged in operative relationship; and a safety lever comprising two operatively connected lever arms extending along opposite sides of the pistol, the lever arms connected by a pivot pin extending transversely through the frame.

In another aspect, the invention relates to a slide action pistol including a frame; a barrel supported on said frame and having a bore on an axis of the barrel; a handgrip portion of the frame provided with a cavity therein for receiving a magazine; a firing assembly including a trigger, hammer and firing pin arranged in operative relationship; and a locking assembly for the barrel, the locking assembly comprising a rotatable lock operatively connected to a barrel release lever, the rotatable lock freeing the barrel and locking the trigger in one position, and freeing the trigger and locking the barrel in another position.

In still another aspect, the invention relates to a slide action pistol including a frame; a barrel supported on the frame and having a bore on an axis of the barrel; a handgrip portion of the frame provided with a cavity therein for receiving a magazine; a firing assembly including a trigger, hammer and firing pin arranged in operative relationship, and a sear element pivotally mounted the frame, the sear element having a tooth engageable with the hammer; a trigger bar operatively connected at one end to the hammer and at an opposite end to the trigger; and a sear bar connected at one end to the sear element, an opposite end of the sear extending forwardly to the trigger.

Other features and advantages of the invention will become apparent from the detailed description which follows.

BRIEF DESCRIPTION OF THE DRAWINGS

FIG. 26 is an enlarged sectional view illustrating the manner in which the safety lever incorporating a ball-detent mechanism to define its operative positions;

FIG. 27 is a perspective view of the trigger;

DETAILED DESCRIPTION OF THE DRAWINGS

Figure 1:
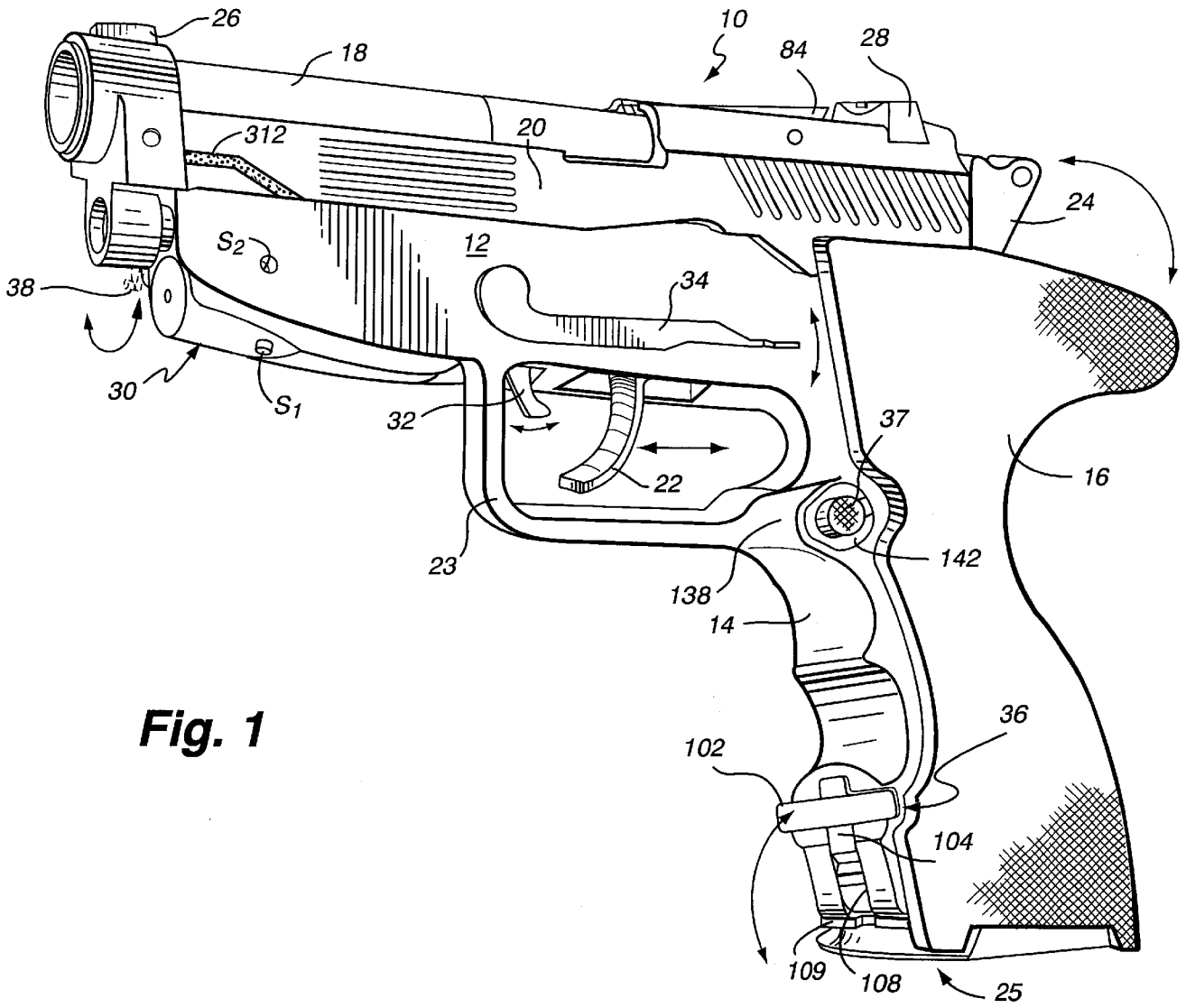
FIG. 1 is a perspective view of a pistol in accordance with one embodiment of this invention.

Referring now to FIG. 1, the pistol 10 in one embodiment of the invention includes, generally, a frame 12 including an integral grip or stock portion 14 (shown covered with wood trim pieces, one shown at 16); a barrel 18, a slide 20, a trigger 22, a hammer 24, and a magazine or clip 25. The components 18, 20,22 and 24 are all supported on or within the frame 12. In addition to these operative components, the pistol also includes a front sight 26, rear sight 28 and a commercially available laser aiming device 30 actuated by lever 32, located within the confines of the trigger guard 23. In a preferred embodiment, the laser aiming device 30 is one which is commercially available under the name "Tekstar 2000 Laser." It is located within a recess formed in the frame below and parallel to the barrel 18. Adjustment screws $S_1$ and $S_2$ are provided to laterally and vertically adjust the aiming device as necessary.

A safety lever 34 moves between locked, semi-automatic and full automatic positions as will be described in greater detail further herein. A field stripping lever 36 and magazine release button 37 permit removal of the magazine (enclosed within the stock 12) and subsequent removal of the slide 20 for cleaning. A barrel locking lever 38 permits quick and easy removal of the barrel 18 for substitution of a longer or silenced barrel, as will also be described in detail below.

The various external and internal components of the pistol will now be described in detail.

The frame 12 and handle 14 may be cut and machined from a solid steel block (or other material, such as aluminum or suitable polymer), or it may be cast in two halves which may be secured together by screws or the like. It will be appreciated that the illustrated frame 12 comprises a solid block, hollowed out (by machining or cutting) and drilled to accommodate the barrel 18, magazine 25, laser aiming system 30, firing mechanism, and other internal components as described further below.

Figure 2:
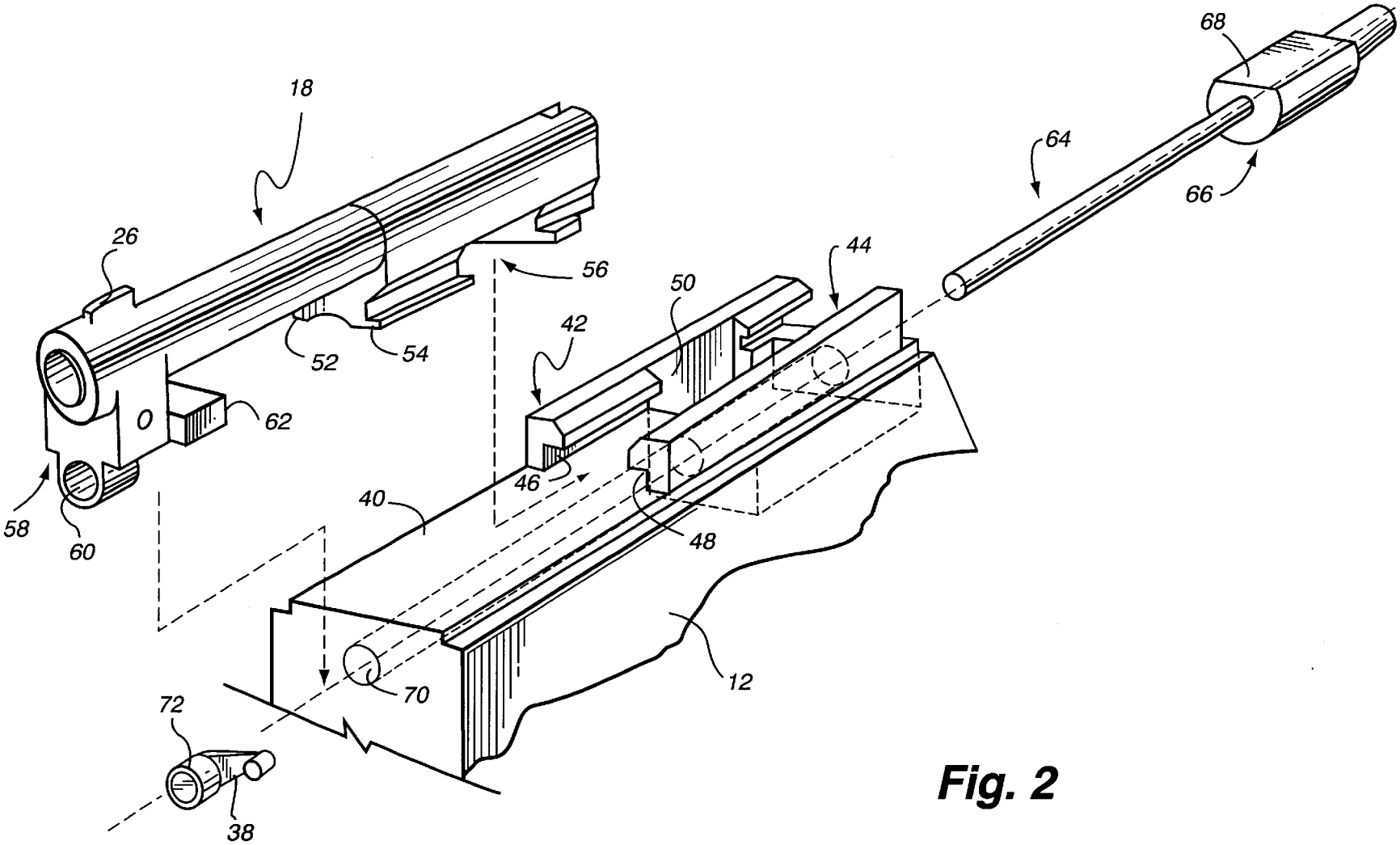
FIG. 2 is an exploded partial perspective view of the pistol barrel and barrel locking mechanism taken from the pistol shown in FIG. 1.
Figure 3:
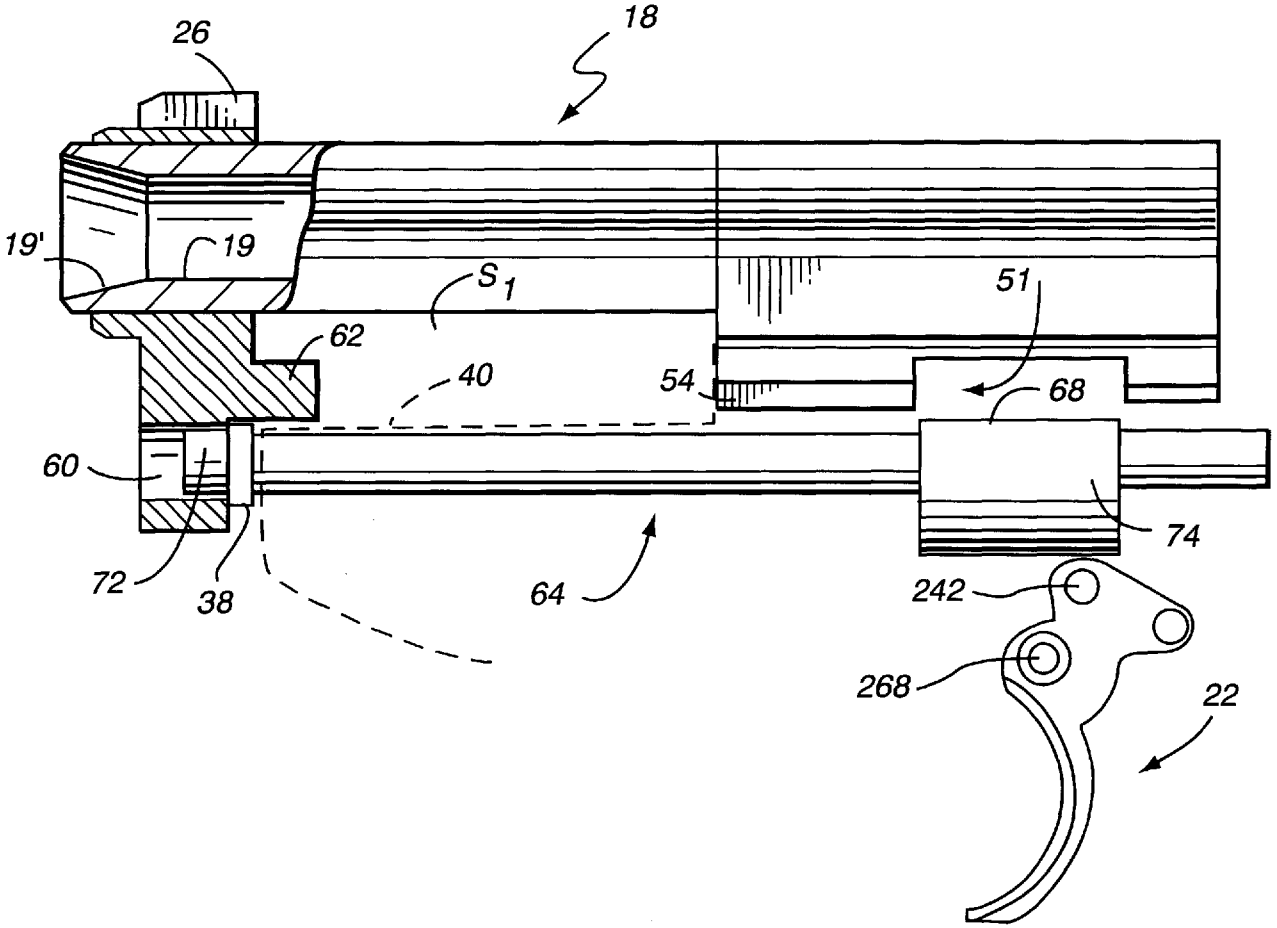
FIG. 3 is a simplified side elevation, partly in section, illustrating the barrel and barrel locking mechanism in an unlocked or release position.
Figure 4:
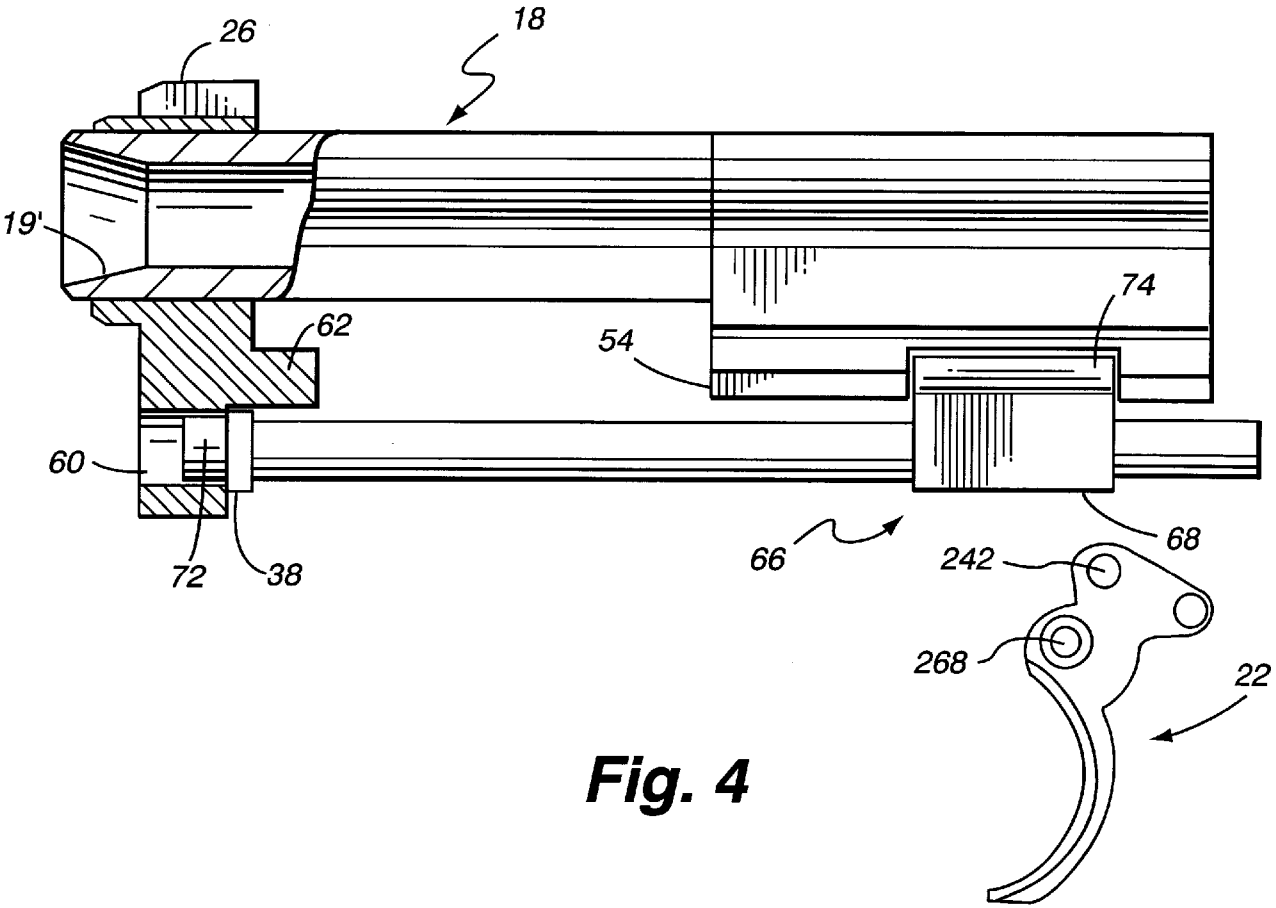
FIG. 4 is a side elevation, partly in section, similar to FIG. 3 but illustrating the barrel locking mechanism in the locked position.
Figure 4A:
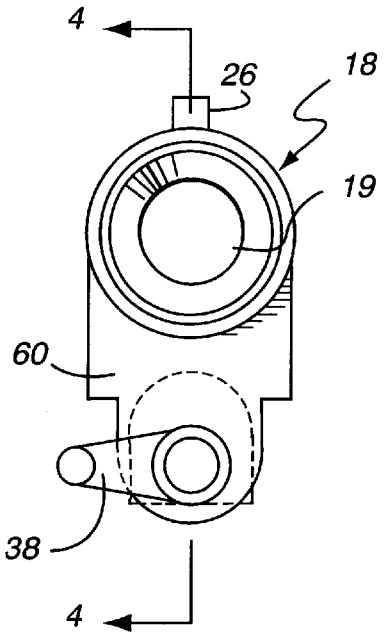
FIG. 4A is a partial front elevation of FIG. 4.
Figure 6:
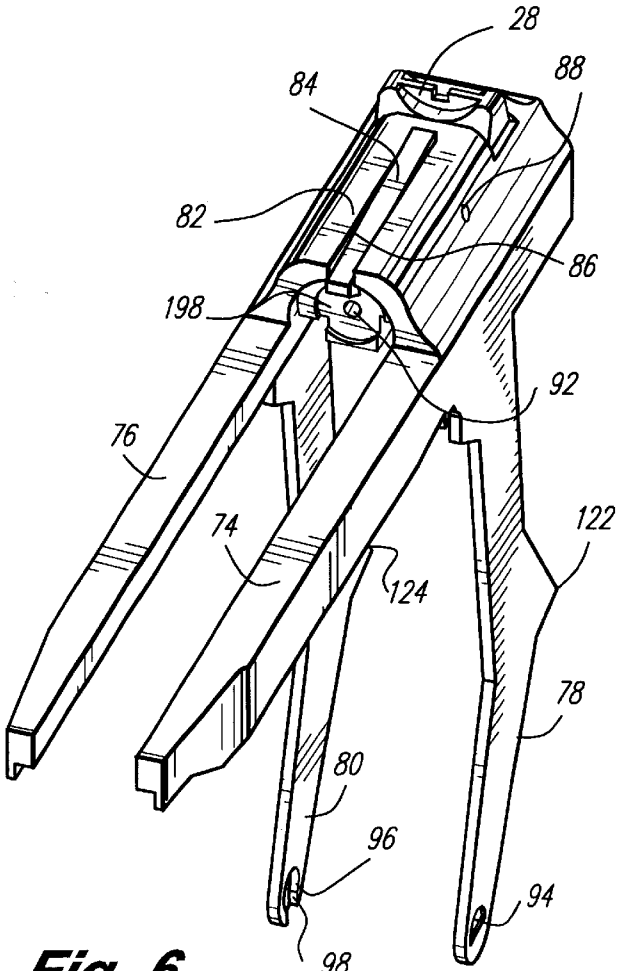
FIG. 6 is a front top perspective view of the slide component.

With reference now especially to FIGS. 2–4, the frame 12 has a generally flat top surface 40 which supports the barrel 18. More specifically, the frame 12 is formed with a pair of longitudinally extending guide rails 42, 44, undercut at 46, 48, respectively, to thereby provide an axial keyway. Approximately midway along the guide rails, there is a cut out or recess 50 which has a width dimension greater than the distance between the undercuts or grooves 46, 48, and which extends downwardly into the frame. The barrel 18 is formed with an axial bore 19 enlarged at the forward end thereof by a tapered edge 19', the latter serving to reduce blast noise. The barrel is also provided on its lower side with mating, laterally extending tracks or tongues 52, 54 which are adapted to slide within the keyway as defined by the undercuts 46, 48 of the guide rails 42, 44. A cut out or recess 56 interrupts the longitudinal continuity of the tracks 52, 54, and is adapted to vertically align with recess 50. This "tongue and groove" or "keyway" arrangement serves to accurately locate the barrel on the frame, and to prevent any lateral movement of the barrel relative to the frame. A forward boss 58 is formed with a bore 60 for receiving the forward tip of a barrel lock shaft 64. The latter is formed with a part-cylindrical locking boss 66 having a flat surface 68. The shaft 64 is slidably received within a bore 70 in the frame, below and axially aligned with the barrel 18, with the boss 66 received within the recess 50. The barrel release/lock lever 38 is telescoped over and attached to the forward tip of the shaft 64 via hollow cylindrical portion 72, permitting the user to rotate the shaft 64. Note that the lever 72 is easily accessed from either side of the pistol.

Figure 3A:
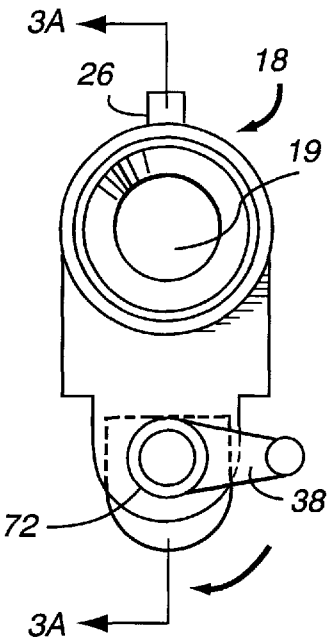
FIG. 3A is a partial front elevation of FIG. 3.

When the barrel 18 is slidably pushed into place on the frame, the bore 60 of boss 58 will slide over the forward, cylindrical portion 72 of lever 38, and recess 56 will align vertically with recess 50. A block or barrel support 62 located behind the boss 58 will rest on the forward end of frame surface 40. Of course, the locking shaft 64 must be rotated so that flat surface 68 is uppermost, as shown in FIGS. 2 and 3 so that it lies flush with, or just below, surface 40, to thereby permit insertion (or removal) of the barrel along the keyway. When lever 38 is rotated clockwise (see FIG. 3A) to the position shown in FIG. 4, the cylindrical portion of the boss 66 projects upwardly into the recess 56 in the barrel, with close tolerance, thereby locking the barrel 18 against any axial movement. As apparent from FIG. 3, and as described in detail further below, when the locking shaft 64 is rotated to the open or barrel release/install position, the cylindrical portion of boss 66 interferes with movement of the trigger 22 so that firing of the pistol is prevented when the barrel is removed, or installed but not locked (even if there is a cartridge in the barrel chamber).

Note also that when the barrel is installed as shown in FIG. 3, the manner in which tracks 52, 54 interact with guide rails 42, 44 creates a space $S_1$ between surface 40 and a forward portion of the barrel through which air can circulate to cool the barrel.

With reference now to FIGS. 1, 5, 6 and 7, the slide 20 is a generally L-shaped, forked component, with a pair of parallel, forward sides 74, 76 which extend along opposite sides of the frame 12 and barrel 18. A pair of parallel rearward sides or legs 78, 80 are substantially perpendicular to sides 74, 76 and extend downwardly, along opposite sides of the grip portion 14 of the frame. It is preferred that the legs 78, 80 be enclosed behind grip trim pieces 16 and, in order to facilitate movement of the slide as described herein, the legs 78, 80 may be seated within oversize grooves or shallow recesses in the sides of the grip portion 14 of the frame. In a most preferred arrangement, the legs 78, 80 may be accommodated on the inside of the frame wall to further isolate the user's hands from the sometimes rapid movement of the slide and the heat generated by such movement.

The respective sides 74, 78 and 76, 80 of the slide are joined by a "yoke" or web portion 82, the latter supporting a cartridge case extractor 84 within an elongated slot 86. The extractor 84 is pivotally supported by a pin 88 and is biased in a counterclockwise direction (as viewed in FIG. 7) by a coil spring 90 seated within the yoke, at the rearward end of the ejector. Below the extractor 84, the yoke is provided with a countersunk, axially extending bore 92 which is adapted to receive a firing pin 192 described in greater detail below. The yoke portion 82 also mounts the rear sight 28.

Figure 5:
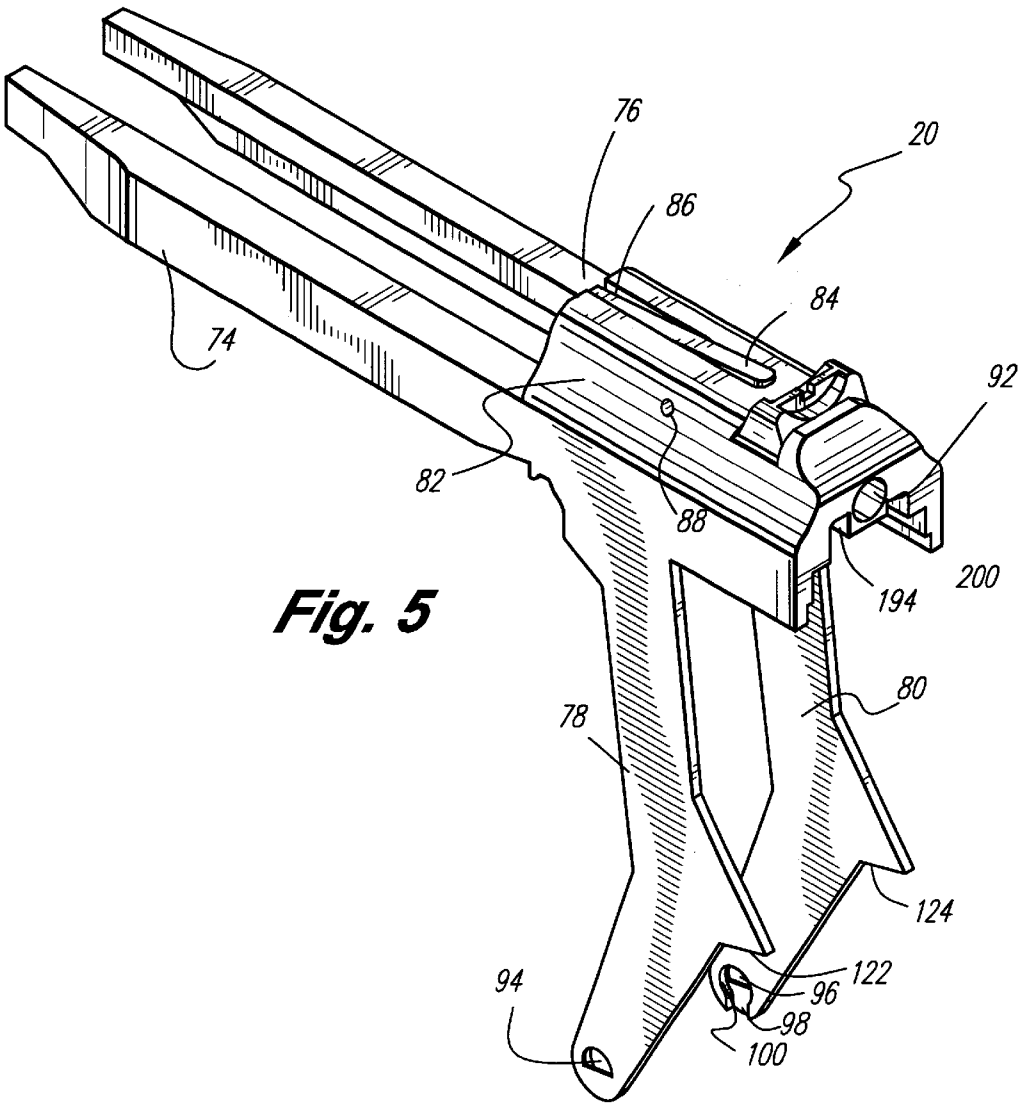
FIG. 5 is a rear, top perspective view of the slide component of the pistol shown in FIG. 1.

The lower ends of the rearward sides 78, 80 of the slide are angled back toward the front of the grip, and are provided with apertures 94, 96 by which the slide is pivotally mounted to the frame. Referring especially to FIG. 5, the inside surface of each leg is machined to provide an entry slot 98, leading to a generally circular seat 100.

Figure 7:
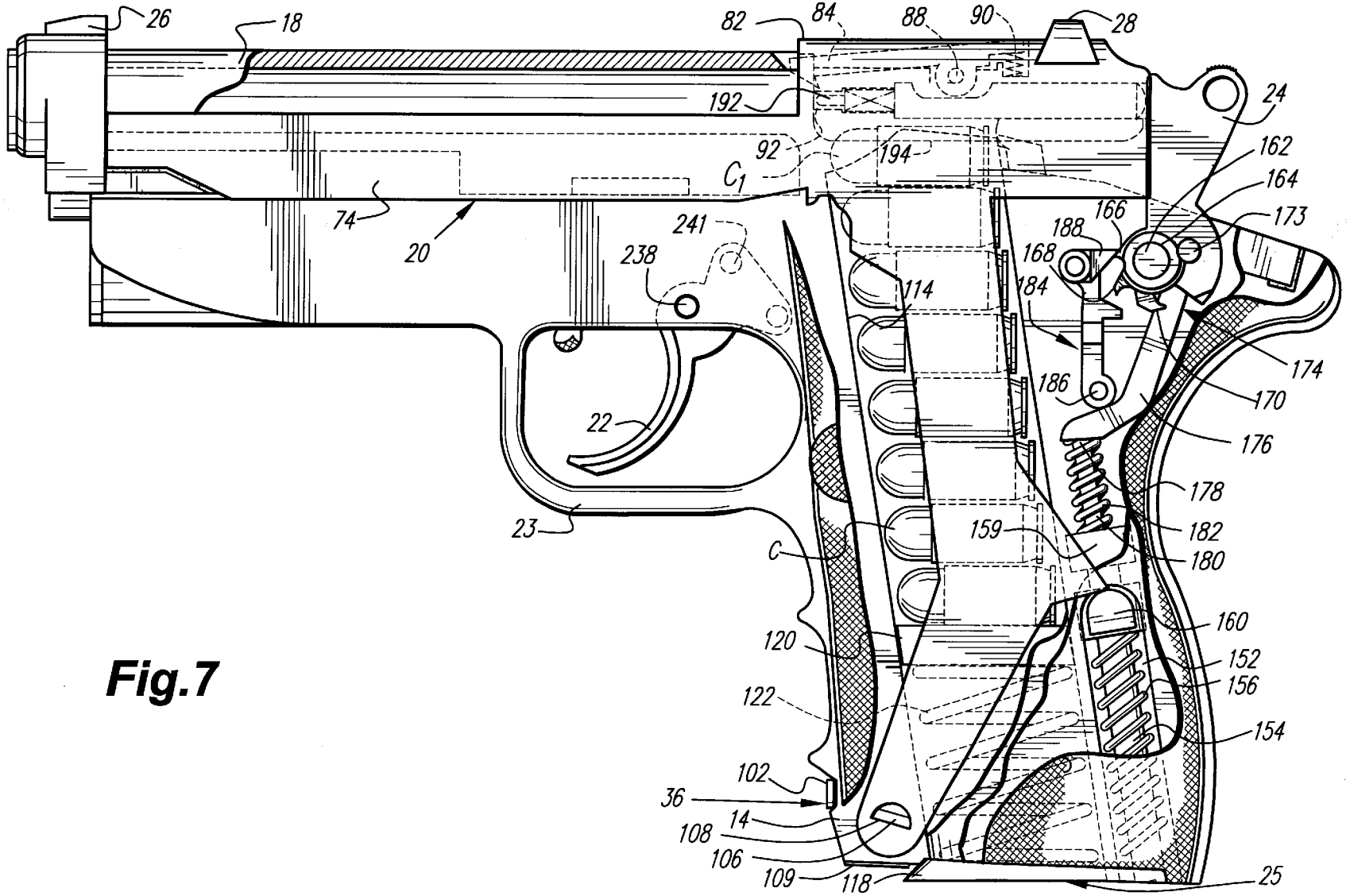
FIG. 7 is a simplified side elevation, partly broken away, illustrating internal components and a fully loaded magazine in the pistol.
Figure 8:
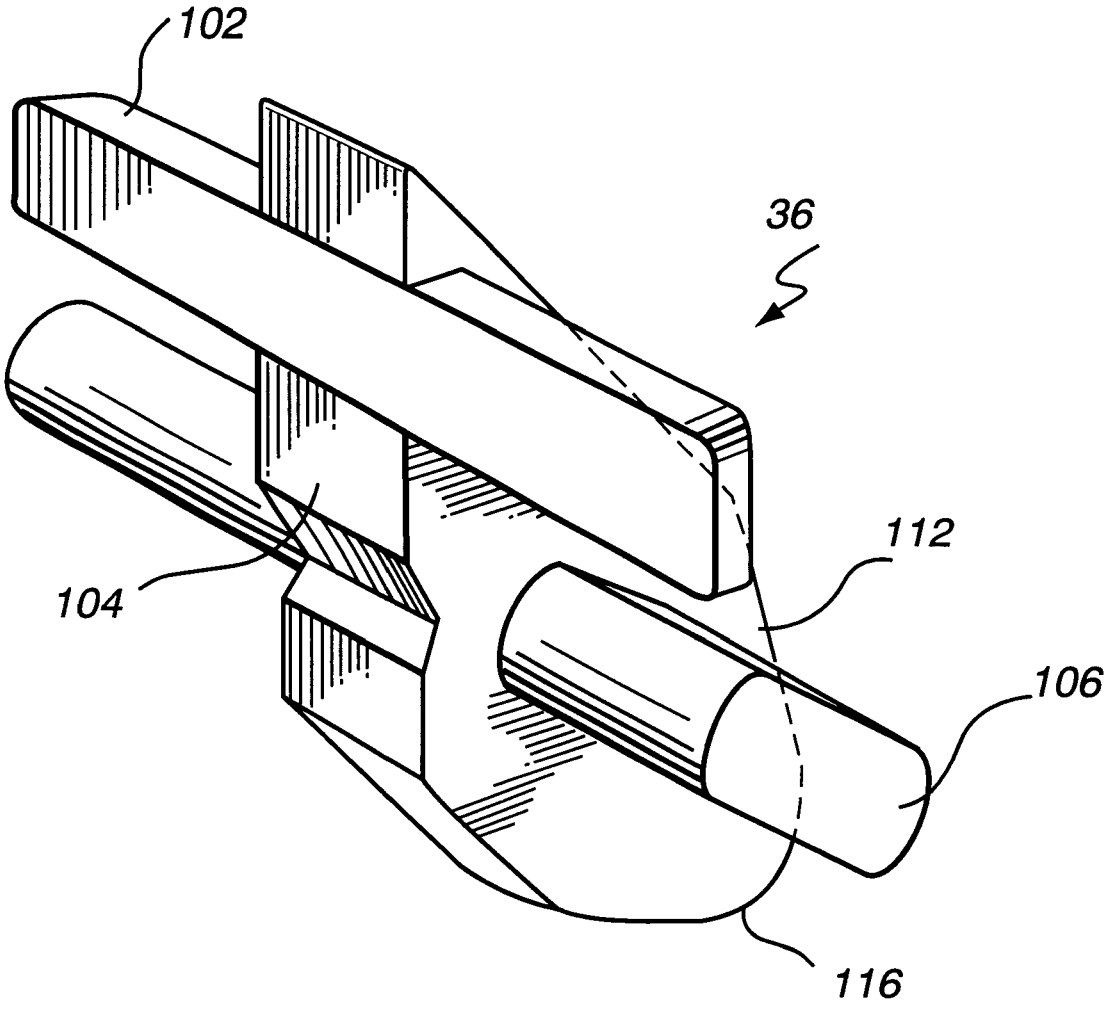
FIG. 8 is an enlarged perspective view of a field stripping lever taken from FIG. 1.

Referring now also to FIGS. 1, 7 and 8, the T field stripping lever 36 includes a transverse actuator bar 102 and a perpendicular stem 104. The latch also mounts a transverse pin 106 having a generally elongated, or rounded rectangular cross sectional shape. The lever is seated within a slot 108 formed at the forward, lower end of the grip portion 14 of the frame. The latter is formed with aligned holes 110 (see FIG. 13) which receive the pin 106 such that the lever 36 is pivotable between lock and release positions, described further below. The otherwise open slot 108 is closed at its lower open end, after installation of the lever 36, by a plate 109 attached to the frame by screws or other suitable fasteners.

Because the pin 106 is elongated in cross section, the slide 20 must be accurately located for the pin 106 to be received in the entry slots 98 formed on the inside surfaces of rearward sides 78, 80. Accordingly, the pin 106 is oriented relative to the latch lever 36 so that, when the lever 36 is in the open or release position, the slide can be installed on the frame, with legs 78, 80 pushed over the pin 106, and with entry slots 98 permitting the pin to be received within the circular seats 100. The lever 36 is pivotable to the closed or lock position, with pin 106 lying transverse to the entry slots 98, so that the slide is now locked in place. It will be appreciated, however, that the slide is free to pivot about the pin 106 to a limited degree during firing of the pistol as explained further below.

It should also be pointed out that the lever 36 has a surface 112 which lies substantially flush with (or at least does not protrude into) the interior frame cavity 114 which receives the magazine or clip 25 (see FIG. 7). On the other hand, because of the close sliding fit between the magazine 25 and the interior surface of the frame cavity, the lever 36 cannot be pivoted to an open position unless the magazine is first removed. This is because the latch is so configured that a projecting portion 116 moves into the magazine cavity in order to pivot to the open position. This also means, of course, that the magazine cannot be inserted unless the lever 36 is closed.

Figure 9A:
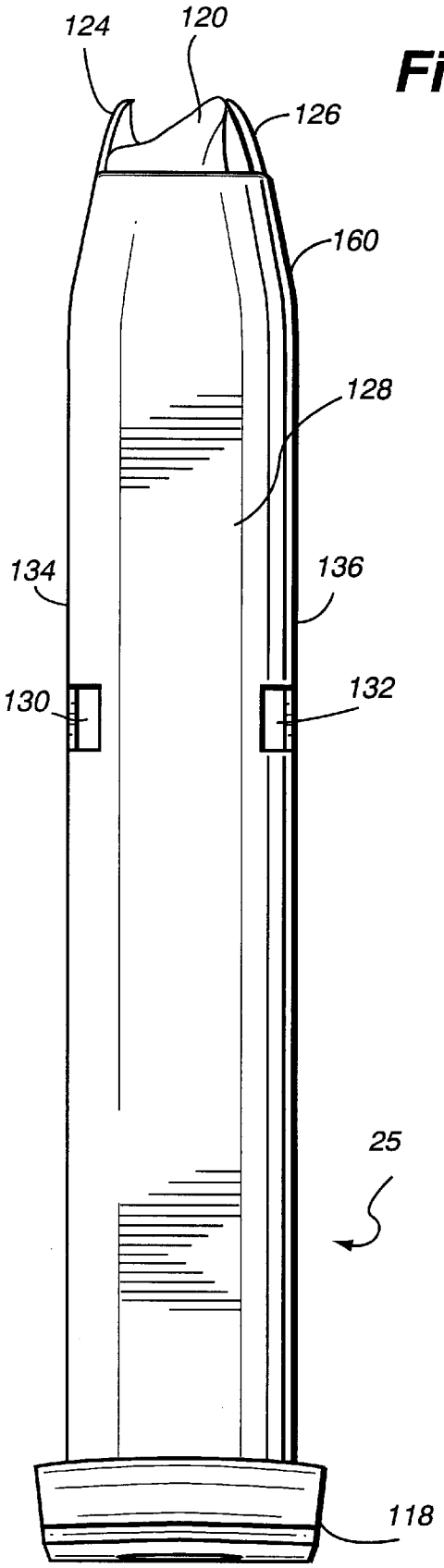
FIG. 9A is an enlarged front elevation of the magazine shown in FIG. 7.
Figure 9B:
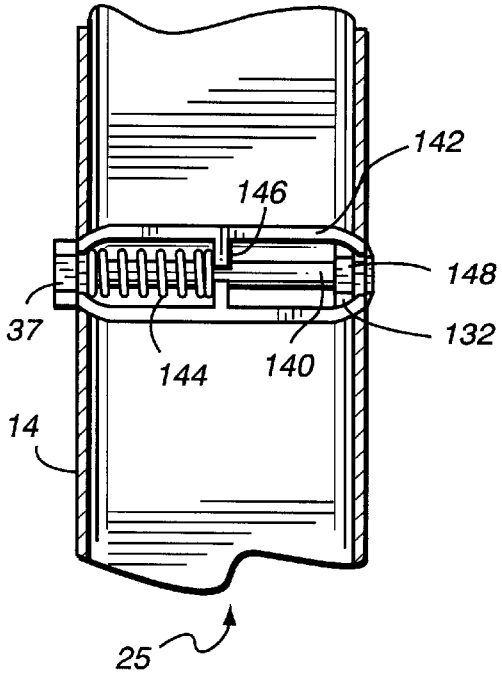
FIG. 9B is a partial section of the magazine of FIG. 9, illustrating a lock/release mechanism in the magazine.

As already indicated above, the magazine 25 (see FIGS. 7, 9A and 9B) is inserted into a cavity 114 in the frame from below the grip. The magazine 25 is of conventional construction including a generally rectangular, hollow housing, with an enlarged base 118, an internal cartridge pusher 120 and a coil spring 122 located between the base 118 and the pusher 120 (see also FIGS. 14–24). In FIG. 9A, the pusher 120 is at the uppermost end of the cartridge since there are no cartridges in the magazine. The upper end of the magazine 25 terminates at two upwardly and slightly outwardly tapering "ears" 124, 126 which prevent the cartridges from escaping the magazine in the upward or feeding direction. In other words, once a cartridge is in the uppermost position within the magazine 25, it can only move forwardly into the pistol chamber, through interaction with the slide 20 as described further below. The magazine may hold fifteen cartridges, but an additional cartridge may be accommodated in the barrel chamber.

When the magazine 25 is inserted into the frame, a spring loaded retainer is employed to lock the magazine in place. More specifically, and with reference to FIGS. 9A and 9B as well as FIG. 1, it will be seen that the forward wall 128 of the magazine 25 has a pair of aligned apertures 130, 132 which also extend partly into adjacent side walls 134, 136. At the same time, the grip portion 14 of the frame 12 is formed with a forward, transverse projection 138 with aligned openings supporting a retainer pin 140. Pin 140 is aligned with magazine apertures 130, 132 when the magazine 25 is fully inserted into the cavity 114 of the frame 12. The pin 140 lies in front of the magazine, however, and is surrounded by a partitioned, generally semi-cylindrical sleeve 142 fixed to the frame which allows a spring 144 acting between the magazine wall 134 and partition 146 to bias the pin 140 to the left as viewed in FIG. 9A. The pin 150 includes the button 37 formed or fixed at one end thereof, projecting from the frame and thus easily accessible to the user. The pin 150 has an enlarged head 148 on its opposite end which, in its normal position, projects into the frame cavity and, into the aperture 132 in the magazine 25, thus holding the latter in place. It will be appreciated that when the button 37 is pressed inwardly against the action of spring 144, the head 148 will move out of the aperture 132 (to the right in FIG. 9A) and, because the pin itself lies forward of the magazine 25 (see FIG. 1), the magazine 25 can be removed by simply pulling on the base 118. Movement in the opposite direction, i.e., during insertion of the magazine 25, the forward tapered surface 150 thereof will ride over the head 148, causing it to move to the right (as viewed in FIG. 8A), until it reaches aperture 132 and snaps back to the left, into its locking position within aperture 132 of the magazine.

Figure 10:
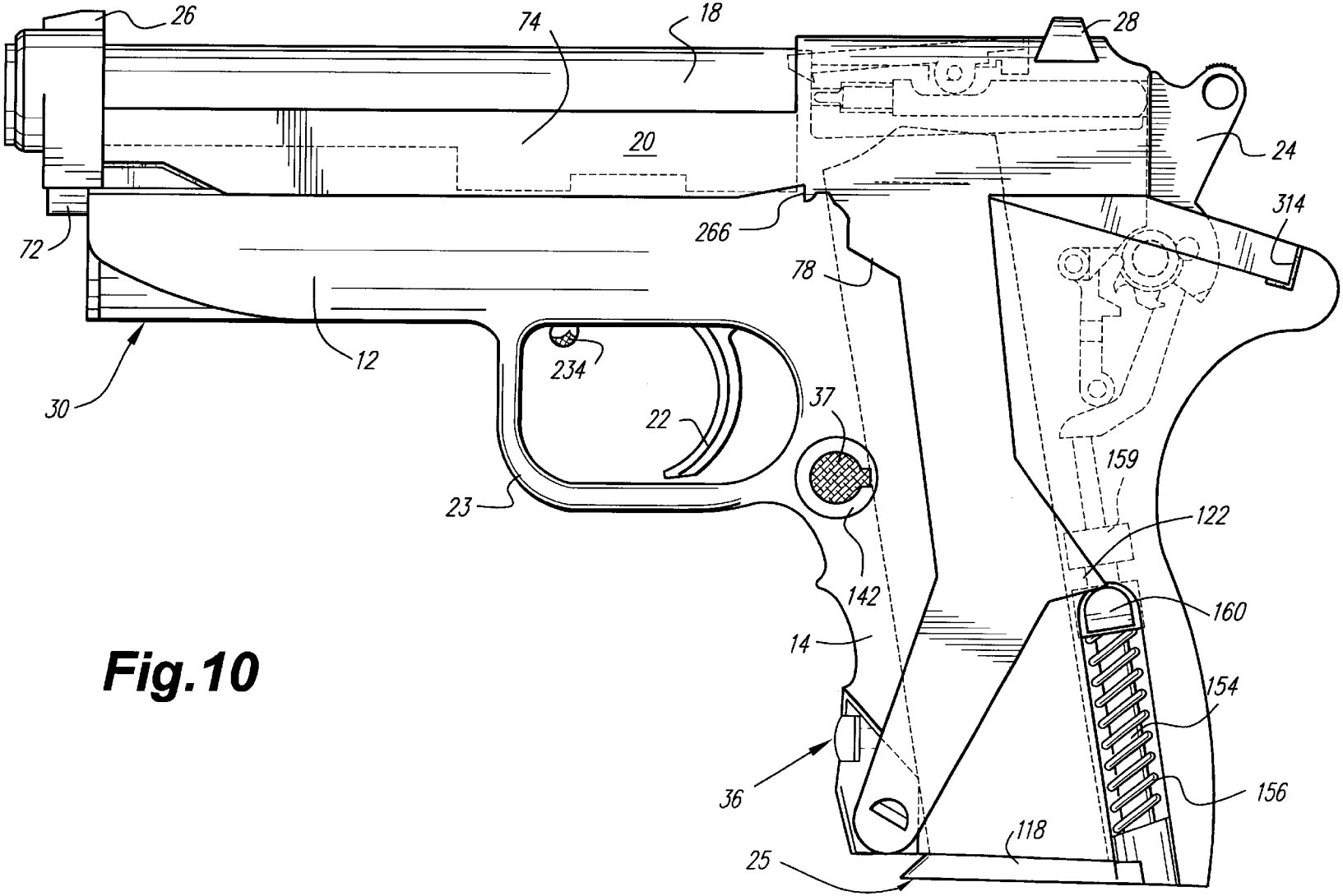
FIGS. 10–13 are simplified side elevations partly broken away, illustrating a step-by-step sequence for removal of the slide in a field stripping procedure.
Figure 11:
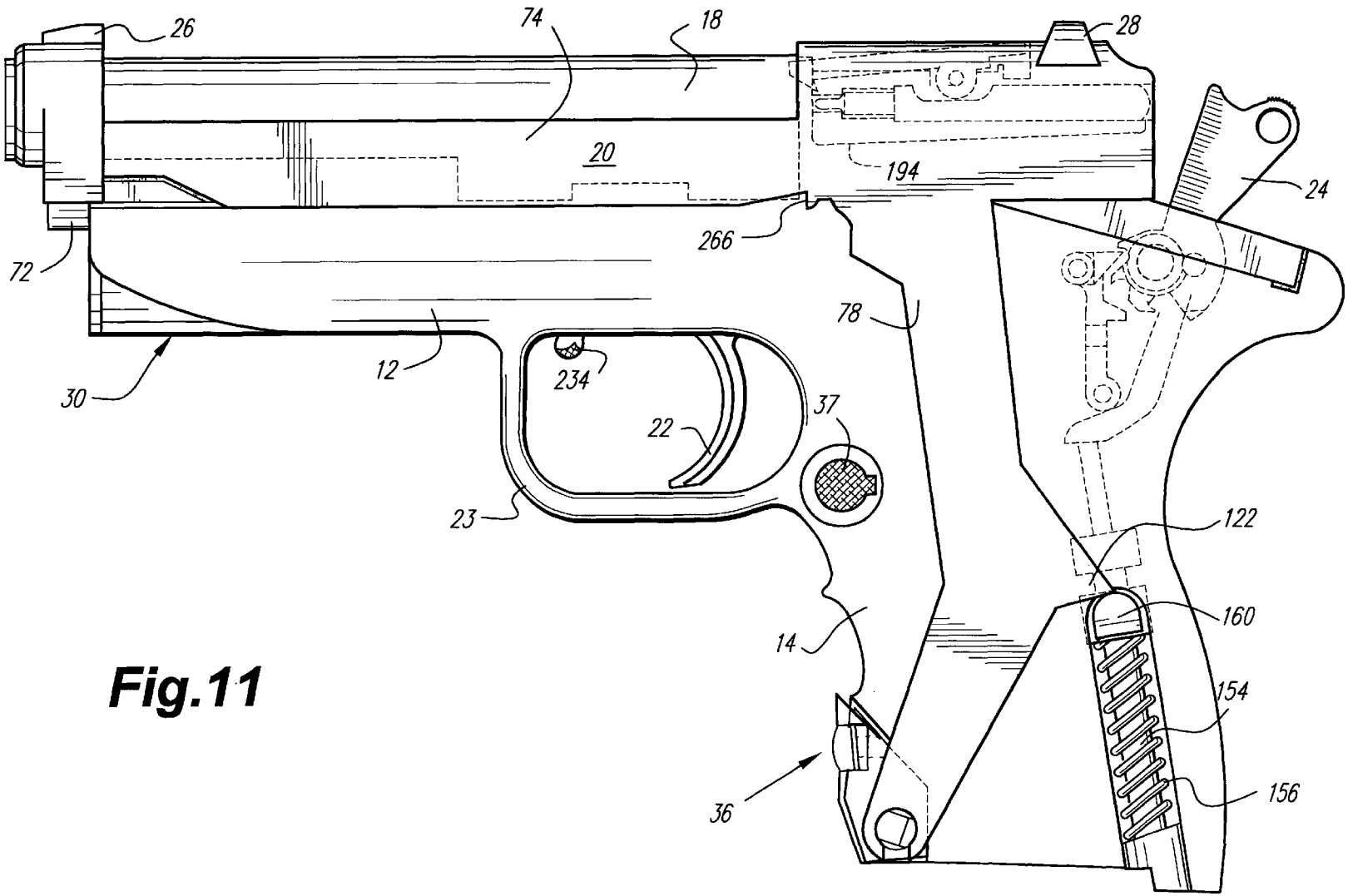
Figure 12:
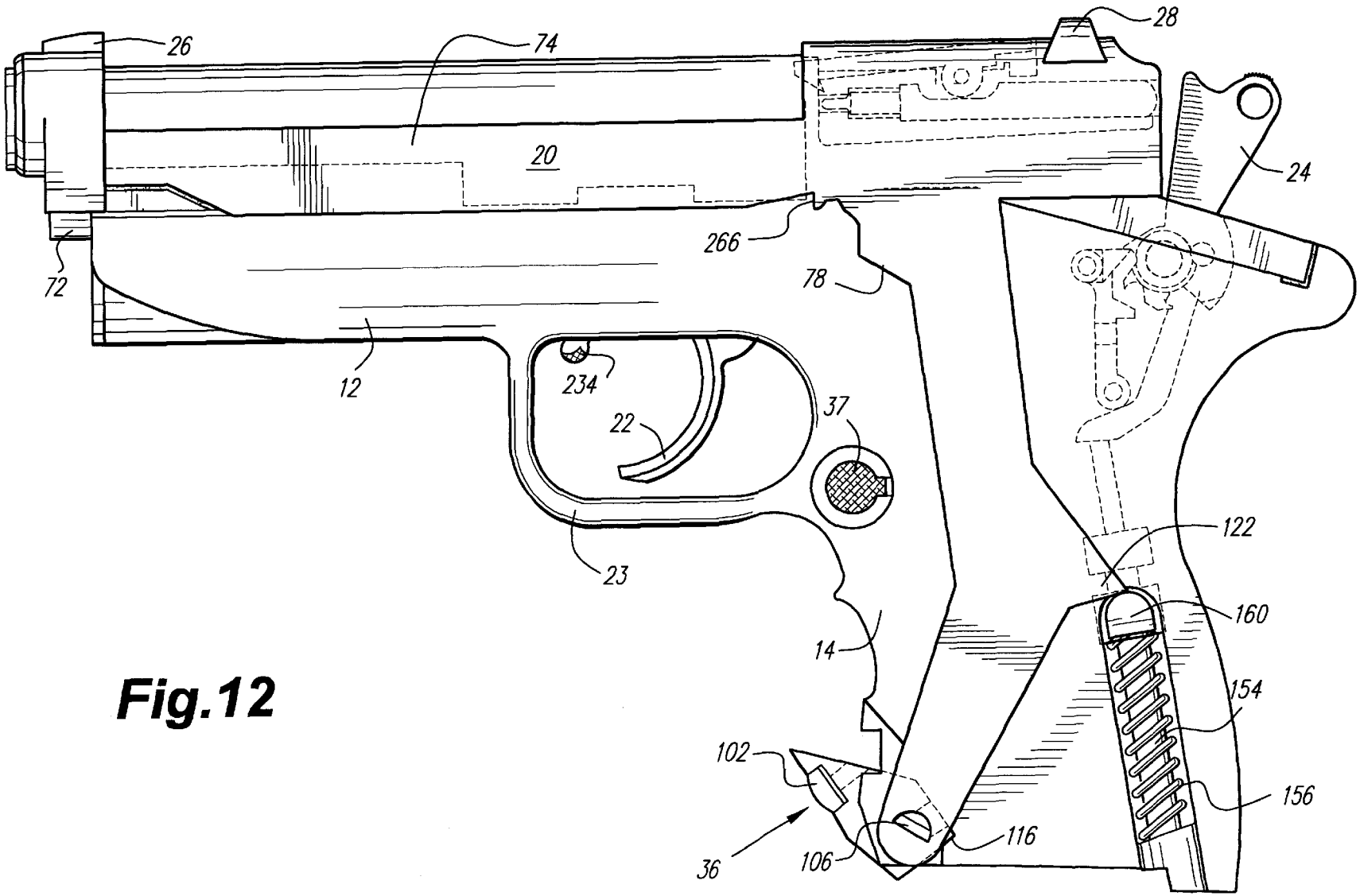

Having described the slide assembly and the magazine construction, a typical field stripping operation can be described now in connection with FIGS. 10–13. FIG. 10 illustrates the pistol prior to starting the field stripping operation. Note that the slide 20 is in its normal closed position, the field stripping lever 36 is closed, the magazine 25 is inserted into the grip portion of the frame, and the hammer 24 is in its forward position. Turning to FIG. 11, the pistol is shown with the hammer 24 pulled rearwardly to a first cocked position so as to allow the slide to be pulled upwardly and rearwardly during its removal, and with the magazine 25 having been removed as described above. In FIG. 12, the slide release lever 36 has been rotated partially in a counterclockwise direction as viewed in the FIG., and note the position of surface 116 within the magazine cavity, confirming that it would be impossible to open the lever with the magazine in place.

Figure 13:
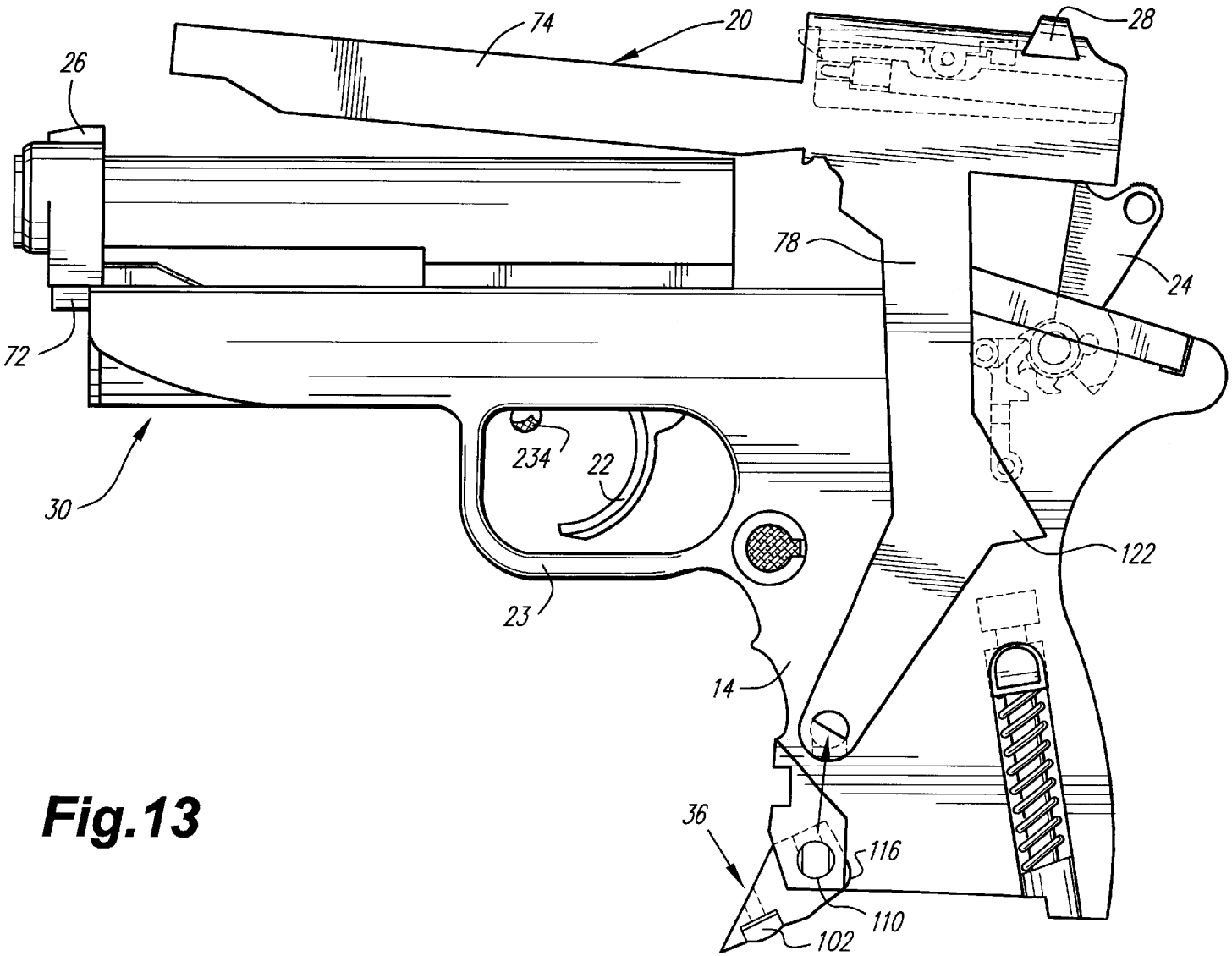

As shown in FIG. 13, the field stripping lever 36 is in its fully open position wherein the pin 106 is aligned with the entry grooves 98 in the slide legs 78, 80, allowing the slide 20 to be lifted upwardly and rearwardly off the pistol frame 12. Note that no other parts need be removed in order to remove the slide 20 including the barrel 18. In other words, the installation and removal of the barrel 18 and slide 20 are independent of each other in that the barrel 18 can be removed and/or replaced without removing the slide 20, and, conversely, the slide 20 can be removed and/or installed without having to first remove the barrel 18. As in the case of barrel release lever 38, the field stripping lever 36 is easily accessed by both right and left handed users by reason of its central location in the grip portion of the frame, and especially by the lateral extent of the actuator bar 102. Here again, no springs or other small parts need be removed in the field stripping procedure.

Figure 7B:
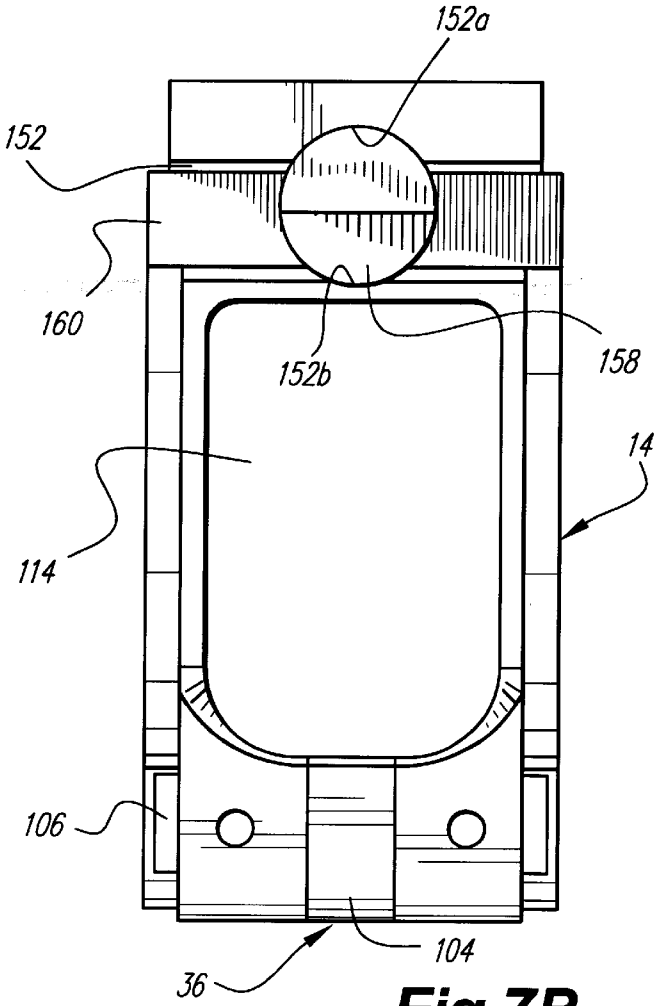
FIG. 7B is an enlarged partial bottom plan of the grip portion of the frame, with parts removed, to show the recoil spring assembly of FIG. 7A in place.
Figure 7A:
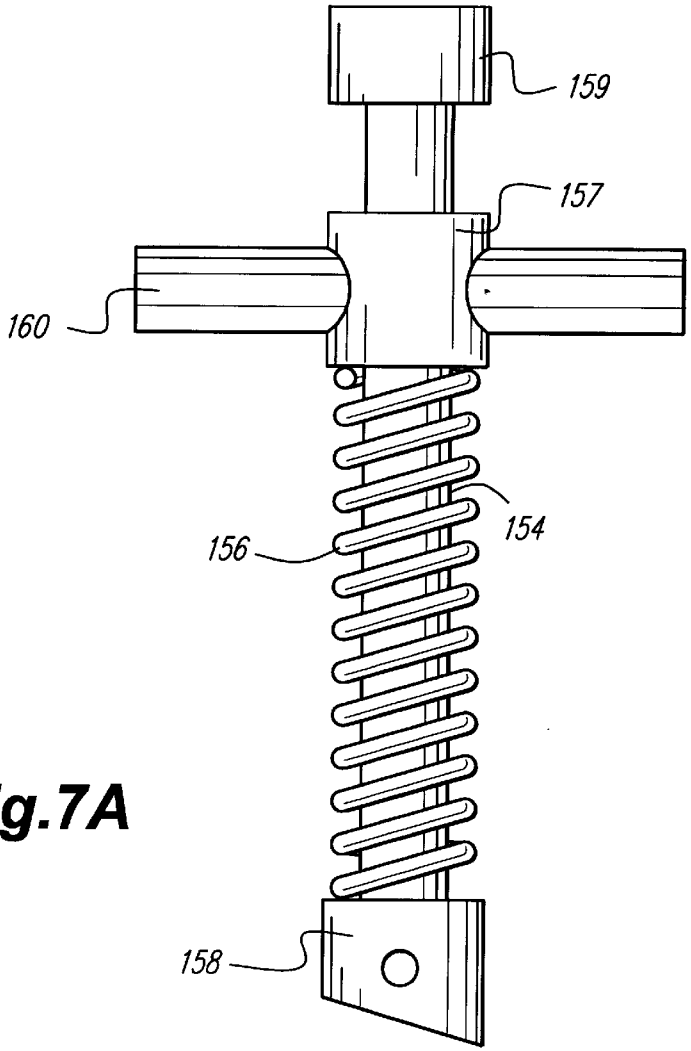
FIG. 7A is an enlarged end elevation of a recoil spring assembly taken from FIG. 7.

Returning to FIG. 7, as well as to FIGS. 7A and 7B, the frame portion 14 is provided with another slot 152 to the rear thereof, open on both sides of the grip portion and extending upwardly from the bottom of the grip portion to a location about midway therealong. Adjacent forward and rearward surfaces of the slot are grooved (at 152*a*, 152*b*) to permit location of a spring assembly including a hollow sleeve 154 (or recoil spring guide) on which a recoil spring 156 is seated, the lower end of the spring engaging an enlarged shoulder or boss 158 on the exterior of the sleeve. A spring cap bar 160 is secured toward the upper end of the sleeve 154, the cap extending transversely so that opposite ends of the cap bar are free to slide within, and project outwardly of, the slot 152 in the frame. These outward ends of the cap are adapted to engage rearward projections 122, 124 on the rearward sides of the legs 78, 80 of the slide 20. In this way, the slide is biased counterclockwise about the pin 102 to a normal position as shown in, e.g., FIGS. 1 and 7. Spring 156 is confined at its upper end by a collar 157, also fixed to the sleeve 154, and from which the bar 160 extends. A boss 159 is provided at the uppermost end of the sleeve 154 to serve as a seal for the hammer spring as described further below. As will be explained in greater detail below, gas expansion upon firing will cause the slide 20 to rotate in a clockwise direction about the pin 106 and, against the action of spring 156. The rotating slide 20 thus acts as a recoil compensation device insofar as the upward (or clockwise) rotation of the slide 20 causes a downward reaction force in the barrel 18, thus balancing the upward component of the usual recoil forces. The recoil spring 156 will return the slide to its normal position. Other features and functions of the slide will be described further below.

Before discussing the manner in which cartridges C are fed to the firing chamber, and the manner in which spent cartridges are extracted and ejected from the pistol, it will be helpful to provide a brief description of the hammer 24, recoil and hammer springs, and an associated sear mechanism. With particular reference again to FIG. 7 as well as FIG. 28, the hammer 24 is pivotally mounted within a slot in the frame 12 by a pin 162 extending through a transverse bore 164 formed in the hammer body, at its lower end. Adjacent the bore 164, and located about a lower peripheral portion (generally on the forward side thereof), there are formed three teeth 166, 168 and 170. Tooth 166 is relatively shallow; intermediate tooth 168 projects somewhat farther, while tooth 170 projects the farthest. On the rearward side of bore 164, there is an adjacent, parallel bore 172 extending through a bifurcated portion of the hammer body, so that a pin 173 of a crank 174 can be pivotally mounted to the hammer. As best seen in FIGS. 7 and 16–21, a generally reverse L-shaped upper crank portion 176 extends downwardly into the grip portion 14 of the frame where a shoulder 178 is provided at the interface of the upper crank portion 176 and a lower hammer spring guide portion 180. The shoulder 178 serves as a stop for a hammer spring 182 telescoped over the spring guide portion 180 of the crank, the spring guide portion comprising a solid rod. The hammer spring 182 is thus confined between the shoulder 178 and collar 159 on the sleeve 154. The latter is free to slide, in telescoping fashion, within the hollow recoil spring guide 154, but the hammer is biased in a forward or firing direction by spring 182, so that when the hammer 24 is pulled rearwardly in a cocking direction, the hammer spring guide 180 slides into the hollow recoil spring guide 154 against the bias of hammer spring 182. Conversely, when the hammer 24 is released, the hammer spring 182 will act through the crank 174 to drive the hammer forwardly, in a counterclockwise direction as viewed in FIG. 7 to strike the firing pin 192 as described further below. Note that hammer 24 does not extend beyond the outline of the pistol frame.

A sear element 184 is also pivotally mounted within the frame by a pin 186, and includes a ratchet tooth 188 engageable with select ones of the hammer teeth 166, 168 and 170. A wire spring 190 supported on pin 186 urges the sear 184 in a clockwise direction, toward the hammer teeth, as viewed, e.g., in FIG. 7. The lower stem 191 of the spring is confined within a groove (not shown) in the pistol frame. Additional details concerning the sear 184 will be provided further below.

Returning to FIG. 7, the pistol is shown with a fully loaded magazine 25, with a series of stacked cartridges C biased upwardly by the internal coil spring 122 via pusher 120. Note, however, that there is no chambered cartridge in FIG. 7, i.e., a cartridge within the barrel 18 just forward of the firing pin 192, ready for firing. As already mentioned, firing pin 192 is slidably mounted in bore 92 in web portion 82 of slide 20. Because there is no chambered cartridge, it can also be seen that the extractor 84 is in its lowered position which, as explained further below, is an indicator to the user that there is no cartridge in the chamber. Note also that the hammer 24 is in a forward, uncocked position and that the slide 20 is in its forward most position. The lower edge or face 194 (see also FIGS. 5, 6) of the slide yoke or web portion 82 holds the uppermost cartridge $C_1$ in the magazine below the chamber, and below the uppermost portion of the magazine.

With FIG. 7 as a base reference, attention is now directed to FIG. 14–24 which illustrate, in sequence, the manner in which cartridges C are fed from the magazine 25 to the firing chamber in the barrel 18. It should also be noted that FIGS. 14–24 which illustrate the cartridge feeding sequence, do not illustrate the linkage between the trigger 22 and the sear/hammer assembly so that the cartridge feeding sequence can be more easily understood.

Figure 14:
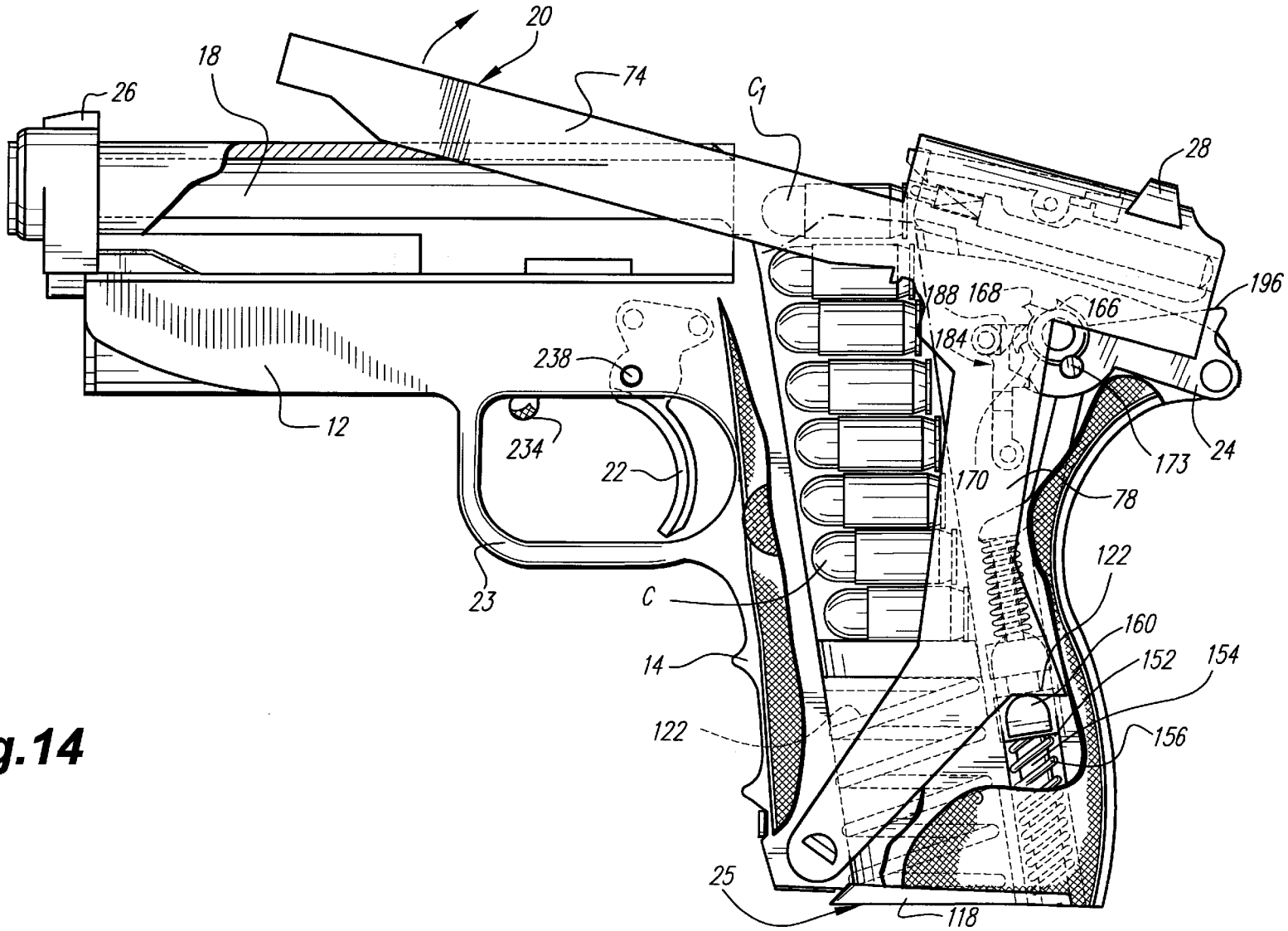
FIGS. 14 through 24 are simplified side elevations, partly broken away, illustrating a step-by-step sequence of feeding cartridges from the magazine into the chamber, with accompanying slide action.
Figure 15:
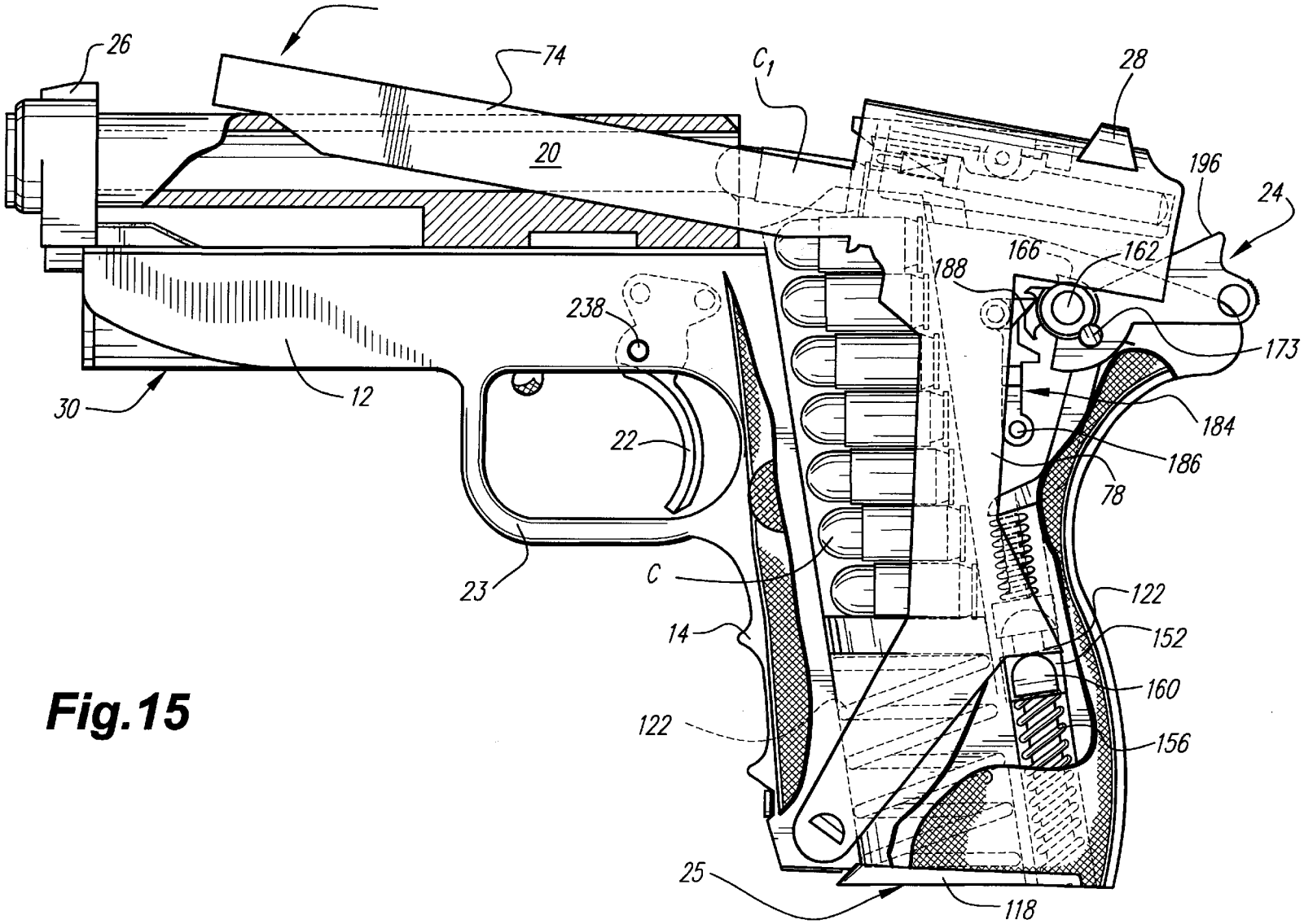

Turning now to FIG. 14, as the slide 20 is rotated manually in a clockwise direction about pin 106 and against the bias of recoil spring 156, the forward face 196 of the hammer is engaged by a back face portion 200 of the yoke portion 82 of the slide 20 (see also FIG. 5) and is therefore also rotated rearwardly in a clockwise direction. As the hammer 24 moves rearwardly, the hammer teeth also rotate in a counterclockwise direction, and the ratchet tooth 188 of the sear 184 rides over teeth 166, 168, thus cocking and holding the hammer 24 in the fully cocked position as shown in FIG. 15. With the slide 20 rotated as described, the cartridges C are free to move upwardly under the biasing action of coil spring 122 located in the lower portion of the magazine, so that the uppermost cartridge $C_1$ moved to the uppermost portion of the magazine, ready to be pushed forwardly into the chamber.

Figure 16:
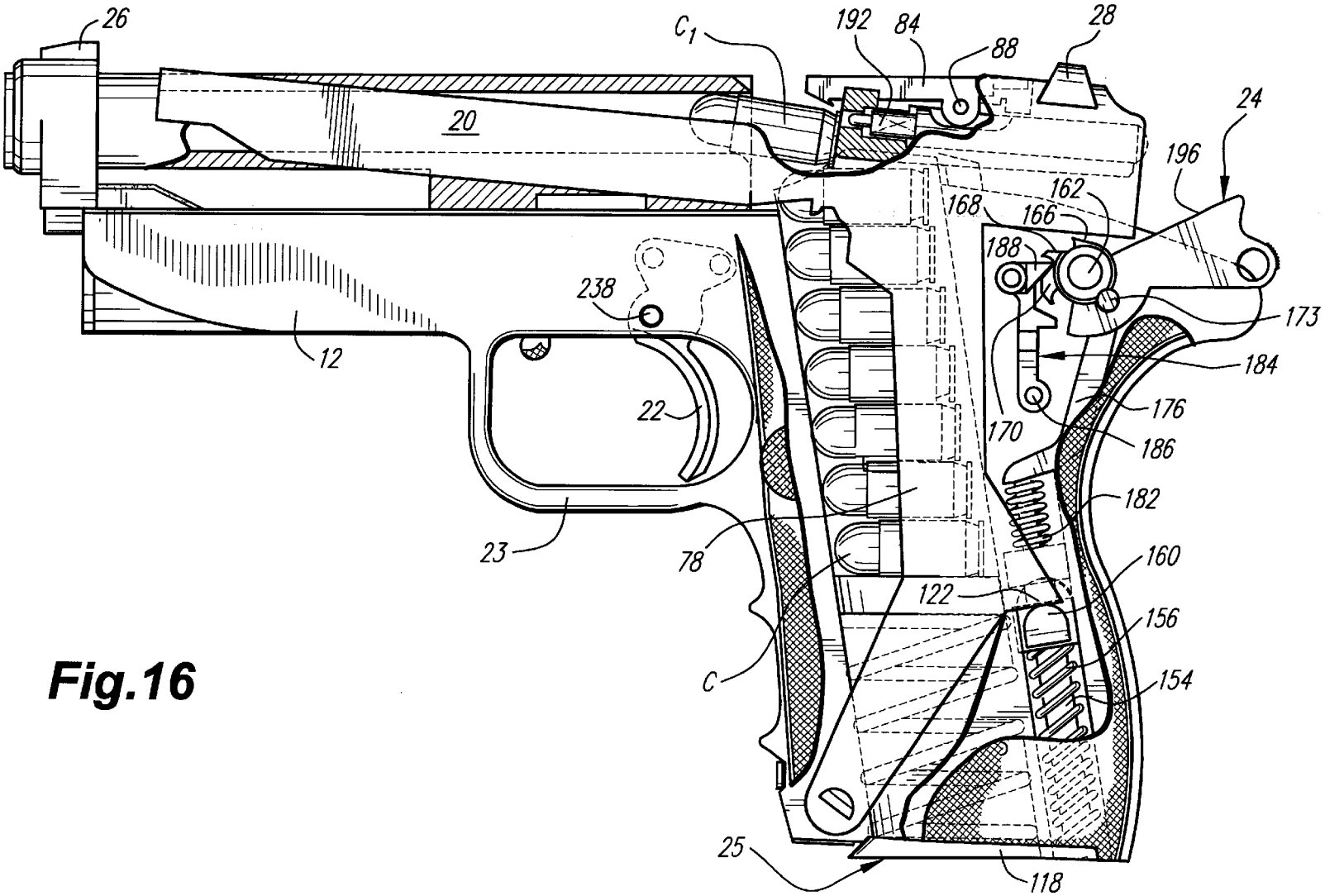
Figure 17:
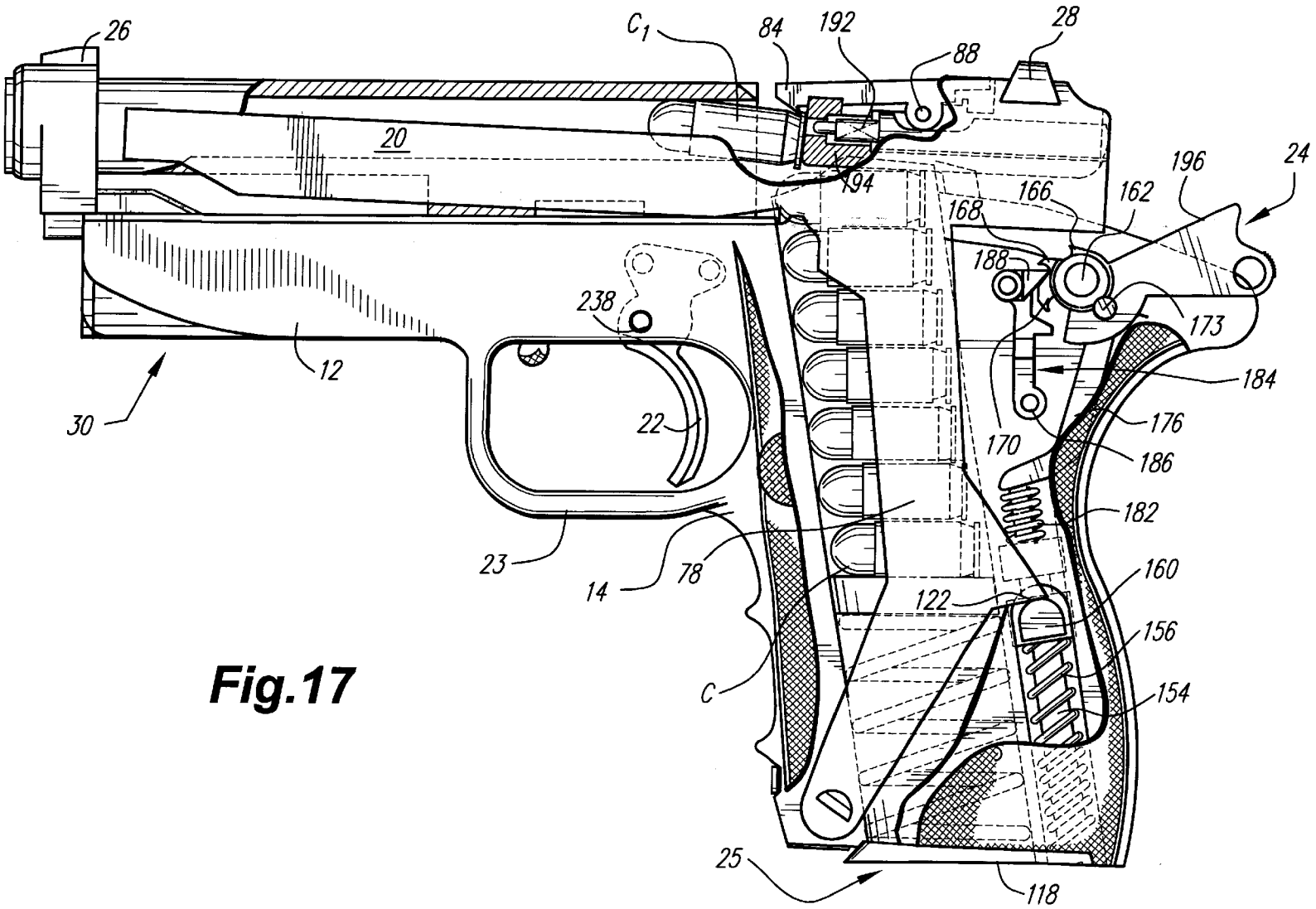
Figure 18:
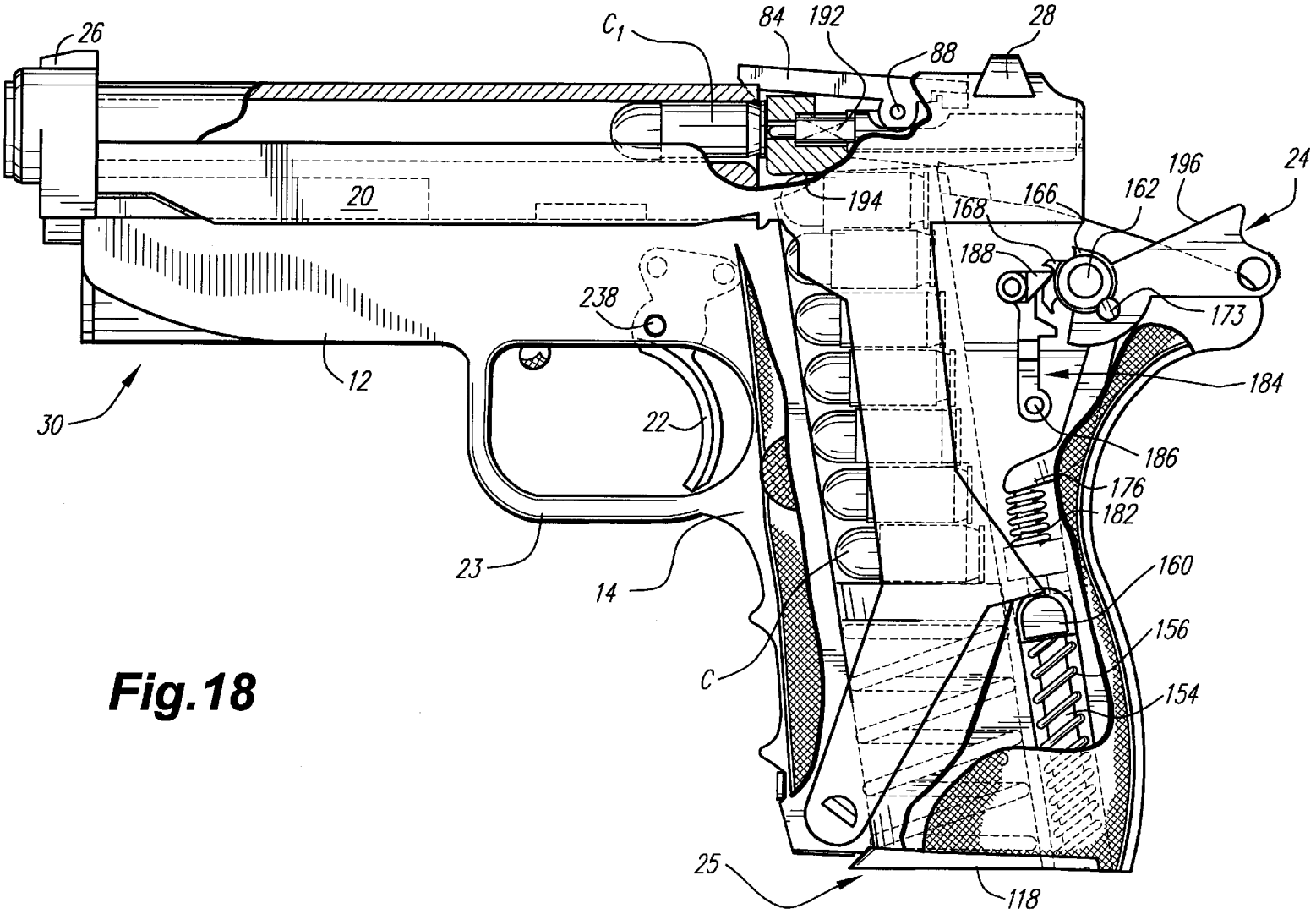

With the hammer 24 held in the cocked position by the sear 184, the slide 20 is now permitted to rotate in a counterclockwise direction back toward its normal position under the influence of the recoil spring 156 acting on projections 122, 124 of the slide legs 78, 80 via the transverse spring cap 160. During this time, the forward face 198 of the yoke portion 82 of the slide 20 is pushing the uppermost cartridge $C_1$ forwardly into the chamber as shown in the sequence illustrated in FIGS. 15–18. In FIG. 15, the cartridge $C_1$ is shown being moved forwardly, with the bullet B just beginning to enter the chamber portion of the barrel. FIG. 16 shows continued movement of the cartridge, and note that the forward edge 202 of the extractor 84 has not yet engaged the radial flange 204 at the rearward end of the cartridge. FIG. 17 shows further progression of the cartridge $C_1$ into the chamber, and the extractor has now engaged the flange 204. FIG. 18 shows the cartridge $C_1$ fully seated within the chamber and note that the extractor edge 202 remains engaged with flange 204, because as the slide 20 closes, it moves forward with the cartridge. The remaining cartridges are held down in the magazine 25 by the lower surface 194 of the slide, as best seen ion FIGS. 18 and 19. Note that the spring loaded extractor 84 is now pushed slightly upwardly to its highest position (approximately 1 mm higher than the slide) by the cartridge $C_1$, providing a visible indicator that a cartridge $C_1$ in this case) is fully chambered. This is especially helpful especially in total darkness where the user can ascertain quickly and unobtrusively that the pistol is ready to fire.

Figure 19:
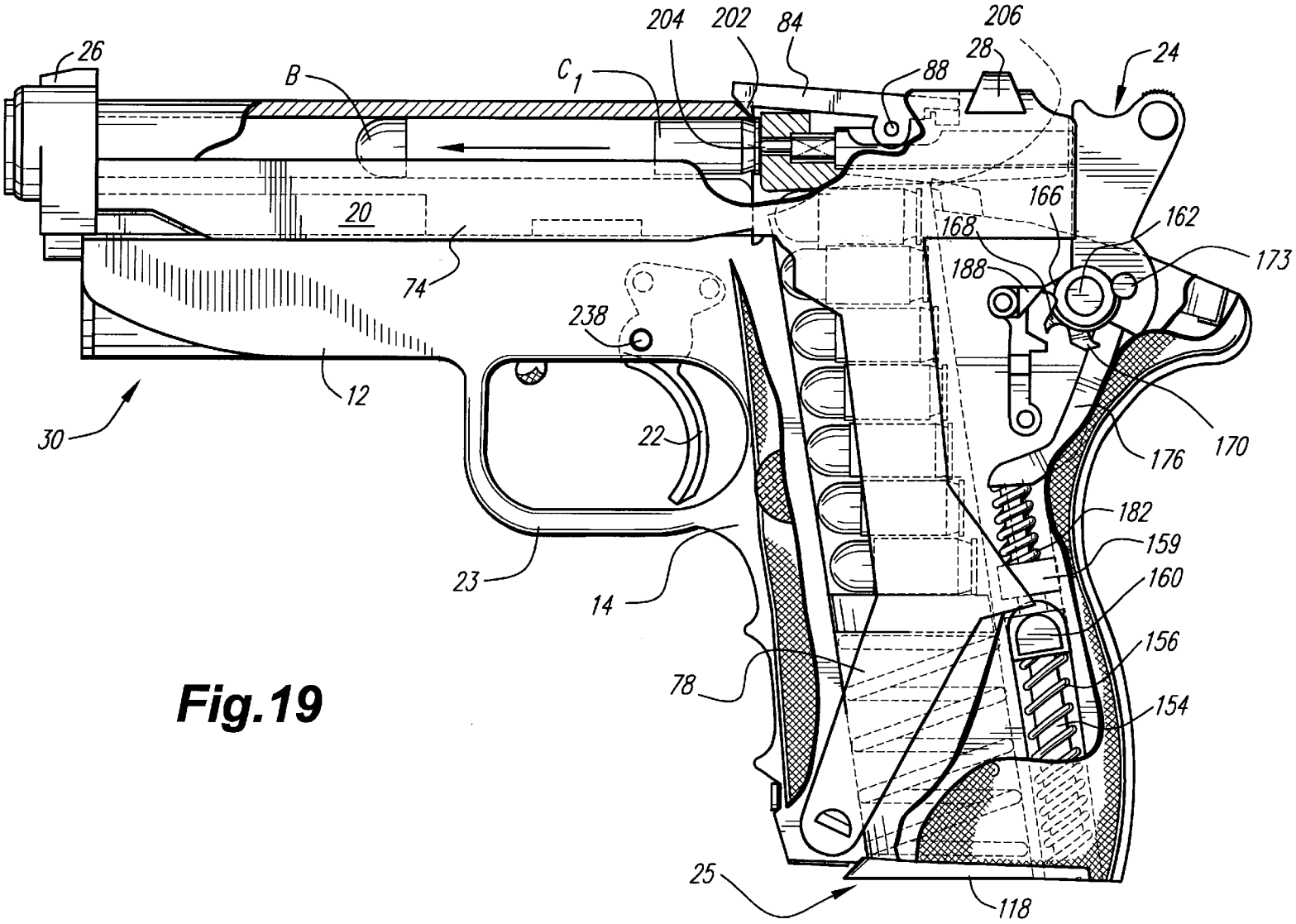
Figure 20:
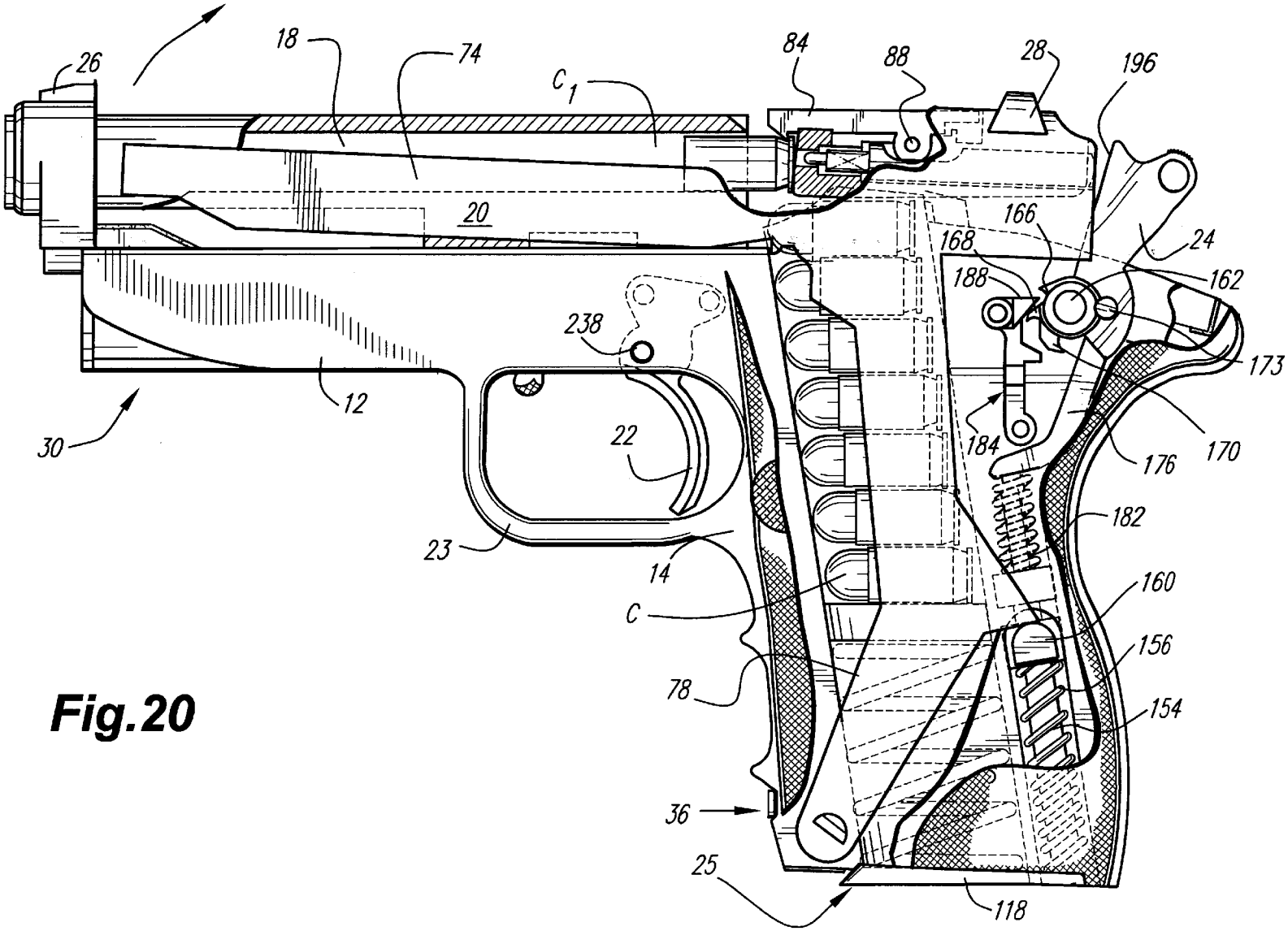
Figure 21:
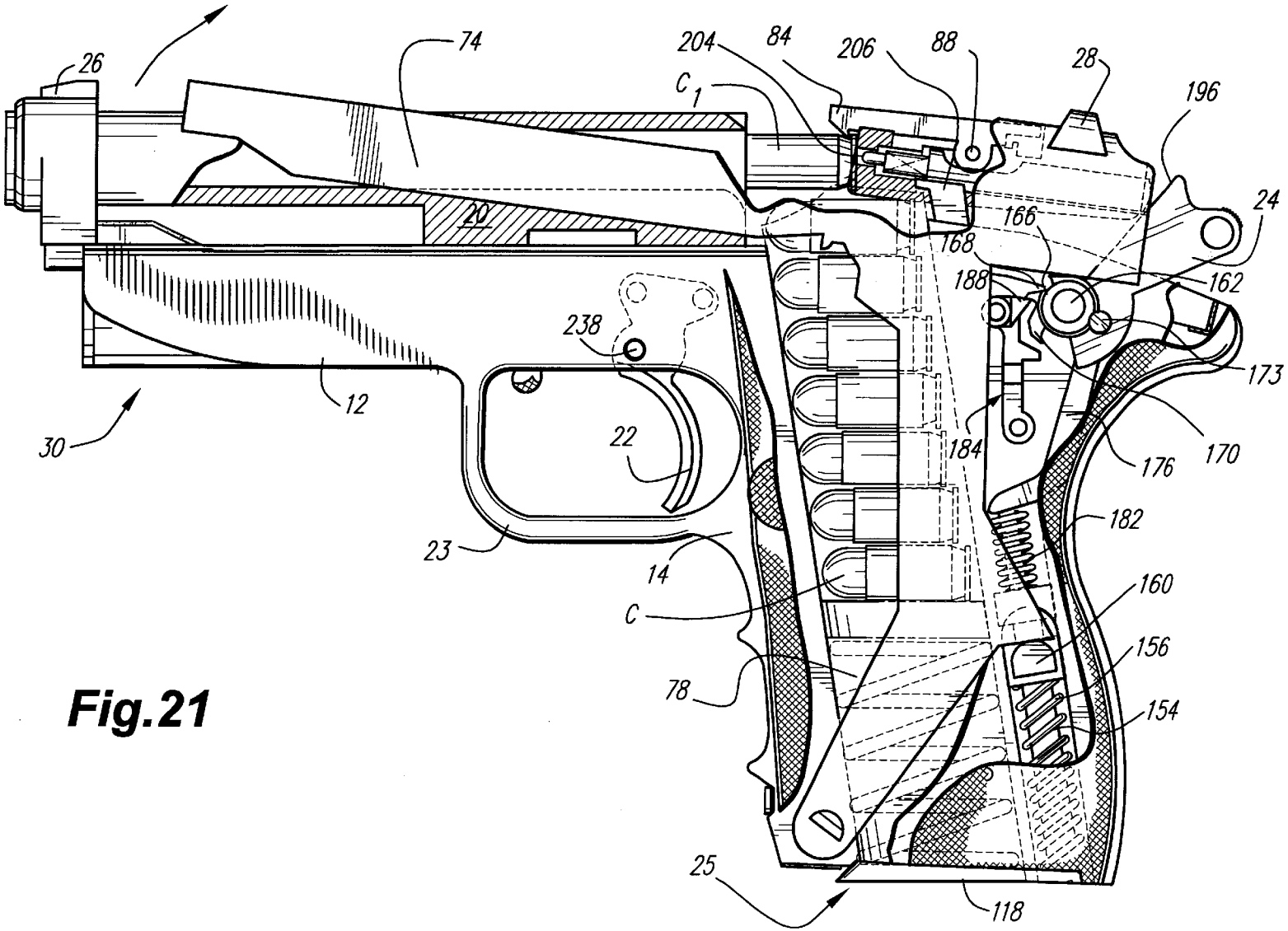
Figure 22:
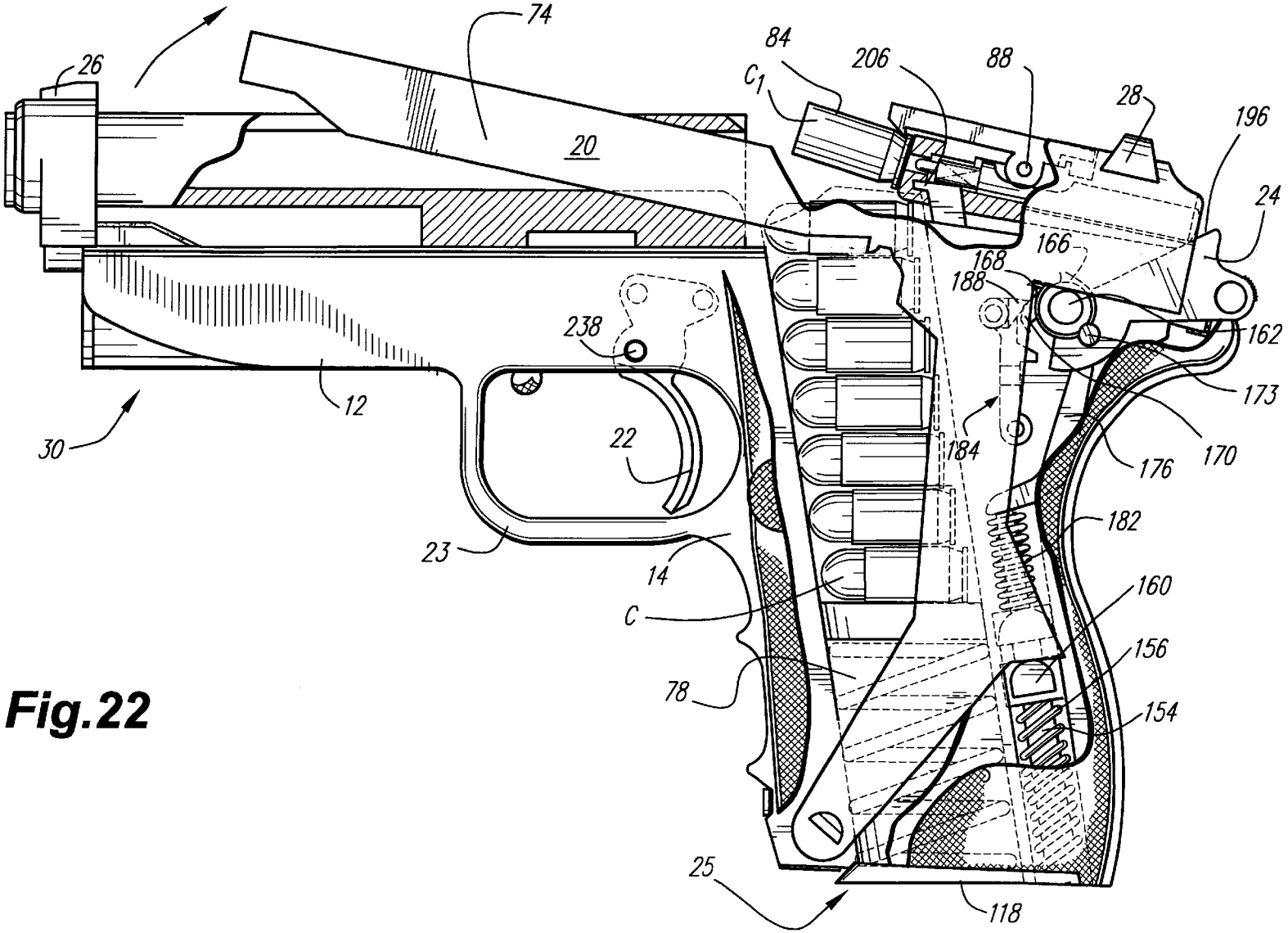
Figure 23:
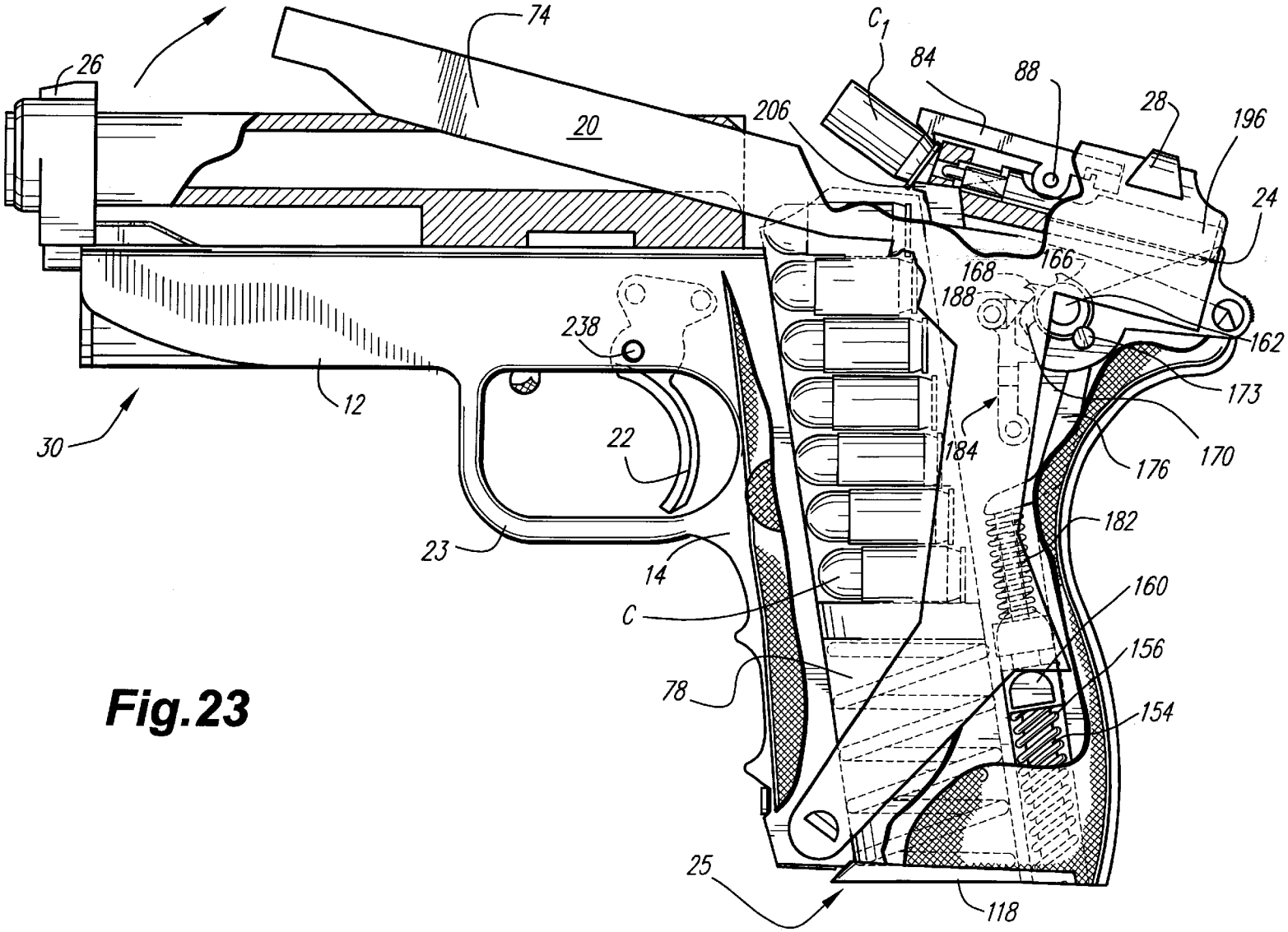
Figure 24:
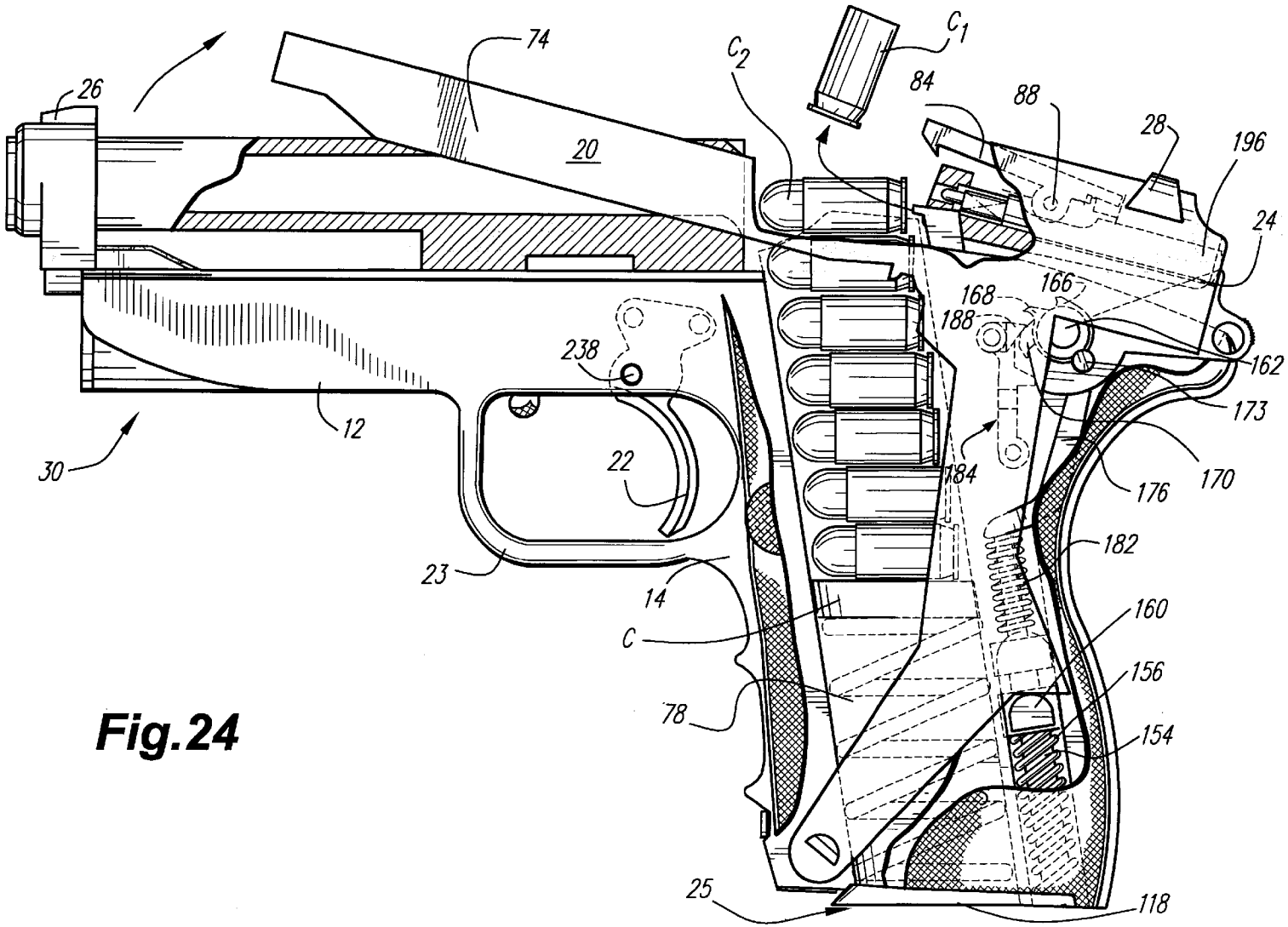

With reference to FIG. 19, when the trigger 22 is pulled and the hammer 24 released (as described in further detail below), the latter rotates in a counterclockwise direction under the influence of the hammer spring 182, driving the firing pin 192, located in slide bore 92, into engagement with the chambered cartridge $C_1$ to fire the shot. Note that the forward hook-like edge 202 of the extractor 84 remains engaged with the radial flange 204. The resulting expansion will cause the slide 20 to rotate in a clockwise direction, upwardly and away from the barrel 18 as illustrated, sequentially, in FIGS. 20–24. At the same time, the bullet B has separated from the now empty cartridge casing $C_1$, and the latter is moving rearwardly with the slide under the impetus of the gas expansion, and by reason of the engagement of edge 202 of extractor 84 with the flange 204 of the cartridge. As the slide 20 is rotated to its open most position as shown in FIG. 24, the empty cartridge casing is engaged by a fixed ejector 206 (see FIG. 23) which effectively pushes the cartridge forwardly, relative to the slide and away from the extractor edge 202. Because the extractor edge 202 is engaged with the radial flange 204 on the cartridge, the latter pivots upwardly and is ejected. Note also that the fixed ejector is offset to the left of the barrel axis so that the cartridge will be ejected upwardly and to the right (FIG. 24), and slightly forwardly. Specifically, the ejector 206 is formed as part of, or fixed to, the frame 12, on one side of the slot formed in the frame in which the hammer 24 is mounted for pivotal motion. Note also that during the recoil action of the slide 20, the hammer 24 is recocked and the next cartridge $C_2$ is fed into the chamber in the same manner as described above.

Figure 25:
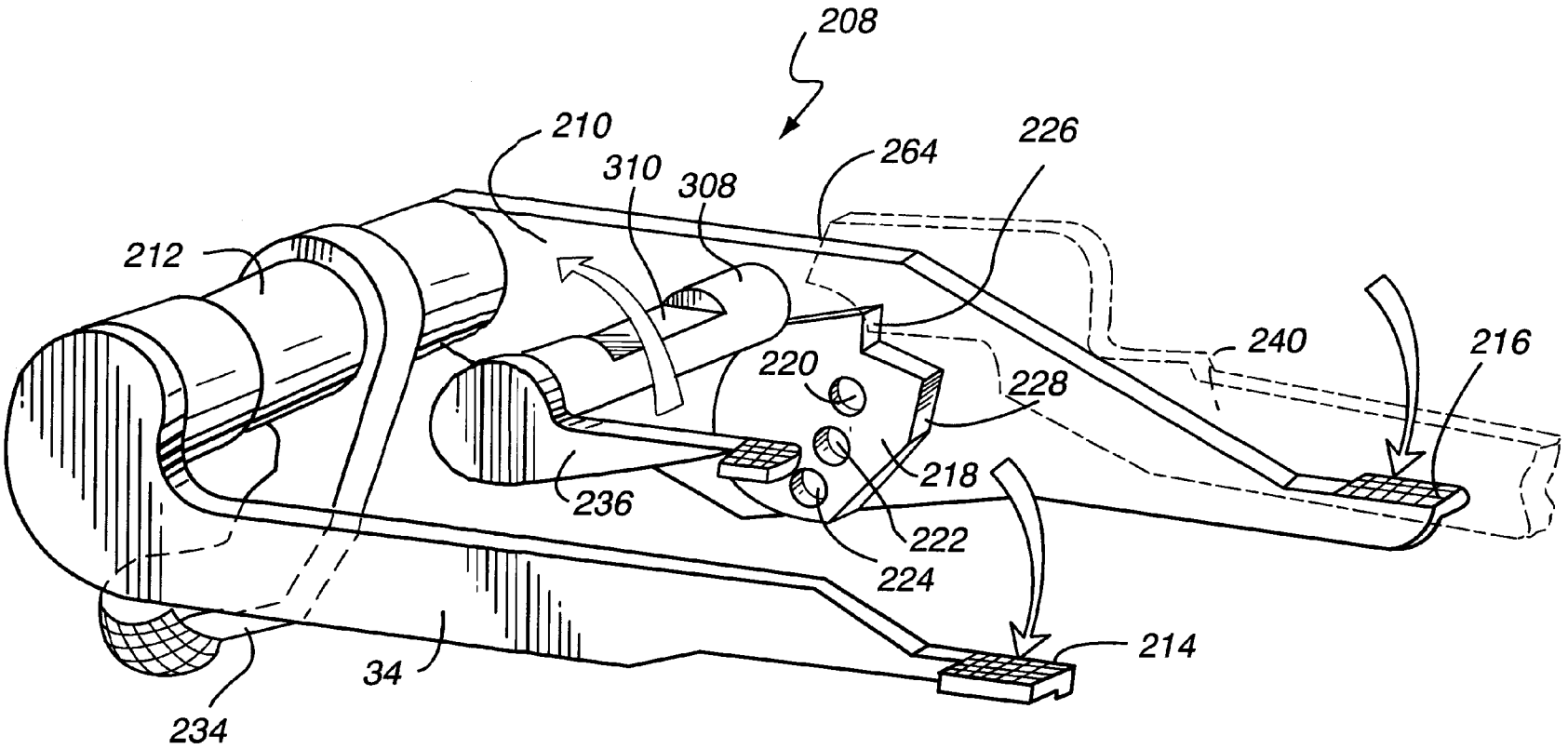
FIG. 25 is a perspective view of the dual safety lever arrangement, in combination with alternative configurations for the laser aiming device actuator lever and for the barrel locking device.

With reference now to FIG. 25, a double safety lever assembly 208 includes the left side lever 34 seen in FIG. 1 and a right side lever 210 fixed relative to each other by a cross-pin 212 extending through a bore in the frame 12, perpendicular to the longitudinal axis of the barrel 18. The safety lever is thus equally accessible by left or right-handed users. The left side lever 34 extends rearwardly, parallel to the frame 12 and slide 20, terminating at a press pad 214. The right side lever 210 also extends rearwardly, parallel to left side lever 34, but along the right side of the pistol frame and slide components, and also includes a press pad 216. The right side lever is dimensioned differently, however, to accommodate a raised platform 218 provided with lever position detents or apertures 220, 222 and 224 as well as substantially vertical stop surfaces 226 and 228 for a trigger actuator bar 240 discussed further below, and shown in phantom in FIG. 25. With reference also to FIG. 26, a spring loaded ball 230 supported within a bore formed in the frame 12 and biased outwardly by spring 232, is adapted to seat, selectively, within the detents 220, 222 or 224 to define controlled movement of the safety levers in three positions: 1) a safety lock position where hole 224 is engaged by ball 230; a semi-automatic firing position where hole 222 is engaged to the ball 230; and a fully automatic firing position where hole 220 is engaged by the same ball. Note that the safety lever is movable between the three positions (with the lever overcoming the resistance created by the spring loaded ball 230) upon exertion of moderate pressure by the user. The ball/detent arrangement thus provides controlled, well defined movement of the safety levers.

It is noted here that FIG. 25 also illustrates a laser aiming device actuator lever 234 and an alternative barrel release lever 236. These are part of an alternative and preferred design which will be discussed further herein.

Figure 28:
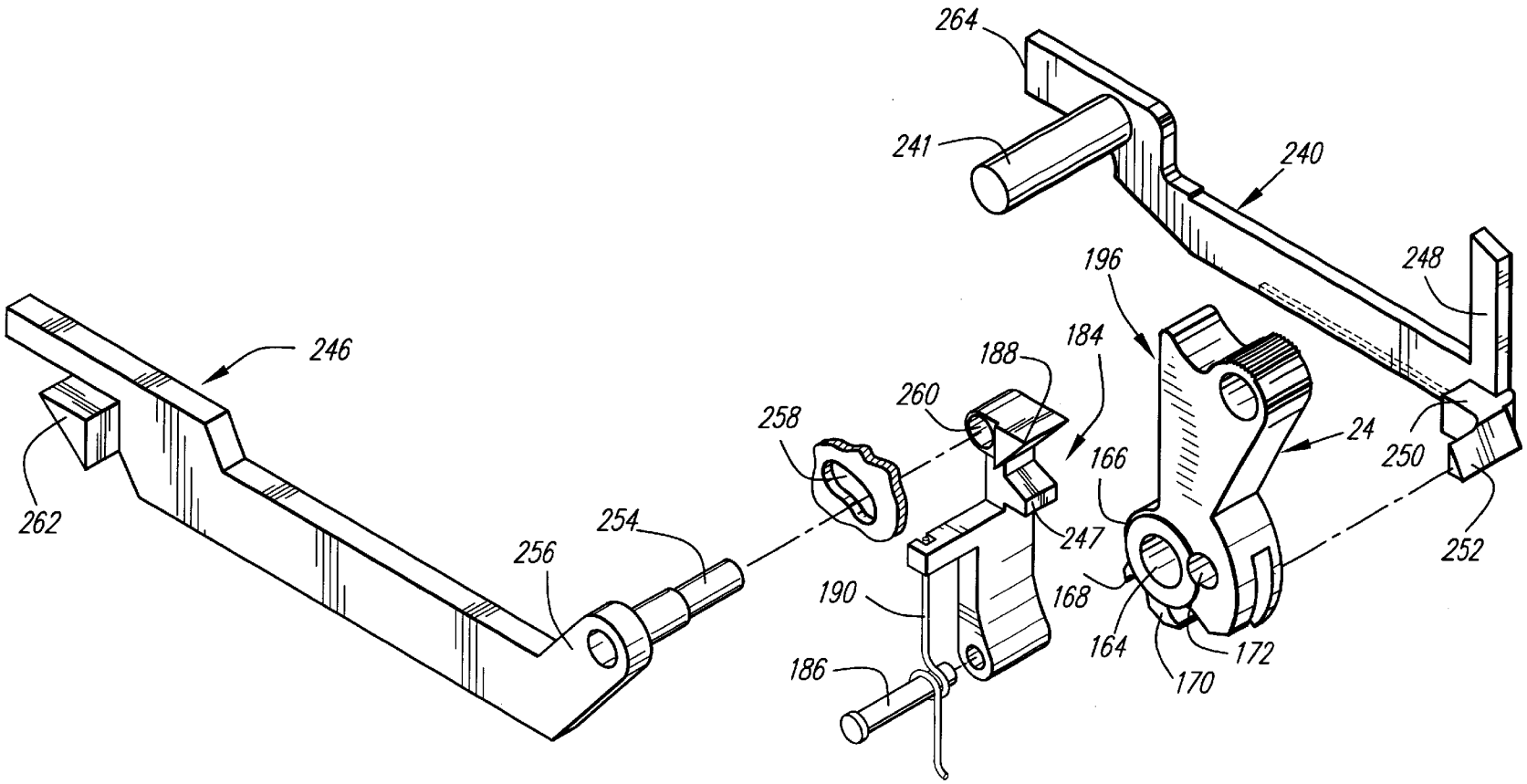
FIG. 28 is an exploded view of the actuator assembly including the trigger bar, sear bar, sear mechanism and hammer.

Turning to FIGS. 27 and 28, the trigger 22 is mounted in the frame via a pivot pin 238 (FIG. 7) extending transversely of the barrel axis. The pin is received in a bore 242 in the trigger, and the ends of the pin are mounted in opposite sides of the frame. As explained further below, a transverse pin 241 on the trigger bar is received within a pair of aligned holes 243, 243' in a bifurcated portion of the trigger. The trigger also mounts a transverse pin 244 which is engaged by a sear bar 246, as explained below. Both the trigger actuator bar 240 and sear bar 246 extend rearwardly, substantially parallel to each other, and connect to the hammer 24 and sear component 184, respectively, as best seen in FIG. 28. More specifically, the trigger bar 240 terminates at its rearward most portion with an upstanding extension 248 lying in the same plane as the bar 240 itself. In addition, a sear release block 250 extends inwardly from the bar 240 in a direction generally parallel to the pin 241. A further lateral tooth extension 252 also extends in that same direction from the rearward face of the block 250. This generally triangular shaped extension is received in a space just behind tooth 170 of the hammer in a normal, uncocked position of the trigger. It will be appreciated that when the bar 240 is drawn forwardly as the trigger is pulled, the hammer 24 will be caused to rotate about its pivot axis in a clockwise direction as viewed in FIG. 28 (in a cocking direction) via engagement of tooth 252 with tooth 170. At the same time, the sear actuator bar 246 is provided with a transverse pin 254 extending laterally from an angled portion 256 of the bar. The pin 254 extends through an arcuate slot 258 formed within the frame and seats within a round hole or bore 260 formed in the sear 184 directly in front of the tooth 188. The sear bar 246 is also formed with a generally triangularly shaped cam element 262 which is adapted to interact with the slide 20 when the pistol is in the full automatic firing mode as explained further below.

The positions of the safety levers and the firing action in the semi-automatic and full automatic modes will now be described.

Full Safety Lock

Figure 29:
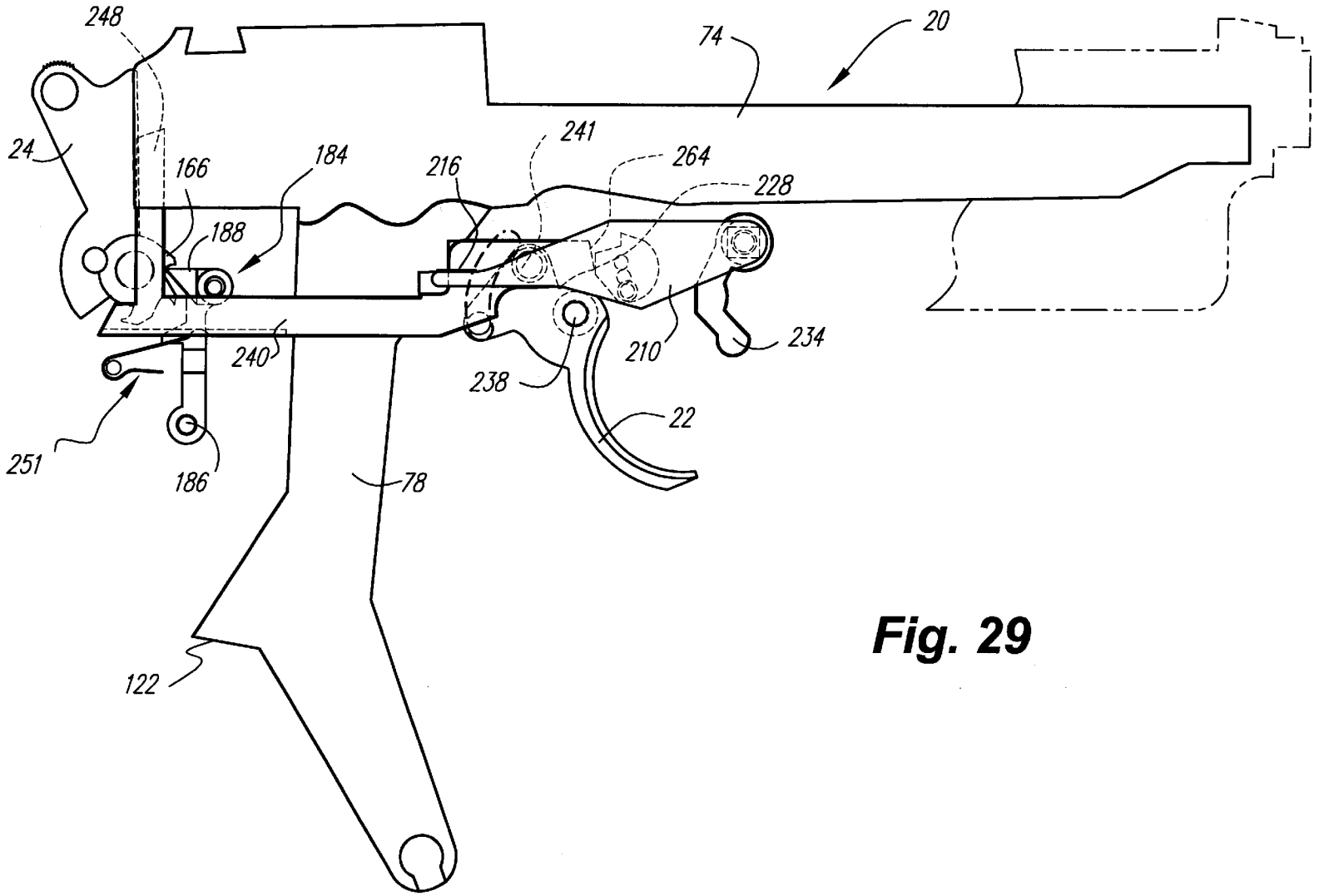
FIGS. 29–37 are simplified side elevations illustrating the positions of the various actuating components during the firing of the pistol in both semi-automatic and automatic modes.

With the safety levers 34 and 210 rotated counterclockwise (or upwardly) as viewed in FIG. 25 to a lock position, ball 230 is engaged in detent 224 and stop surface 228 on the interior of lever 210 is engaged by the forward edge 264 of the trigger bar 240 so as to prevent any movement of the trigger. In other words, and with further reference to FIG. 29, when the trigger is pulled in a firing direction (even with the hammer cocked), it would normally pull the trigger bar 240 forward, in light of the attachment of bar 240 via pin 241 in holes 243, 243' of the trigger which are located above the trigger pivot pin 238 received in transverse bore 242 of the trigger. In full safety mode, stop surface 228 will prevent any such forward movement of the trigger bar and, therefore, the trigger 22 cannot be pulled rearwardly in a firing direction. Thus, FIG. 29 reflects the "at rest" position of the firing components, in a full safety mode.

Semi-Automatic Mode

Referring back to FIG. 25, when safety levers 34 and 210 are moved in a clockwise direction (or downwardly) so that the ball 230 is engaged within detent 222, the trigger bar 240 is able to move in a forward direction beyond stop surface 228 until it engages the second stop surface 226. In other words, the trigger is now permitted limited rearward movement, pulling the trigger bar 240 in a forward direction until the edge 264 engages the stop surface 226. In this position, the trigger can be pulled repeatedly in a single shot or semi-automatic mode, but cannot be pulled so far to the rear that full automatic firing is enabled.

Figure 30:
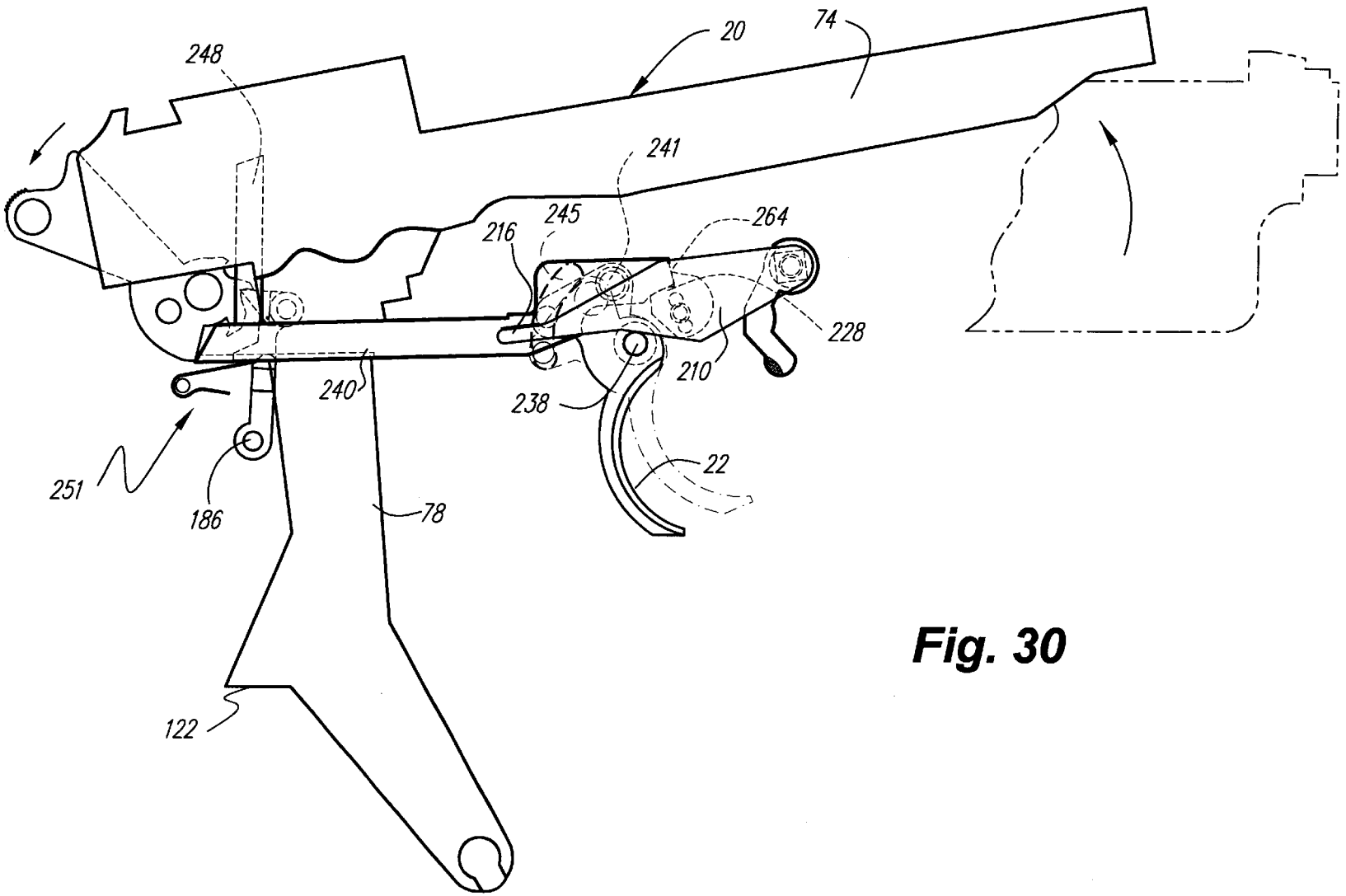
Figure 33:
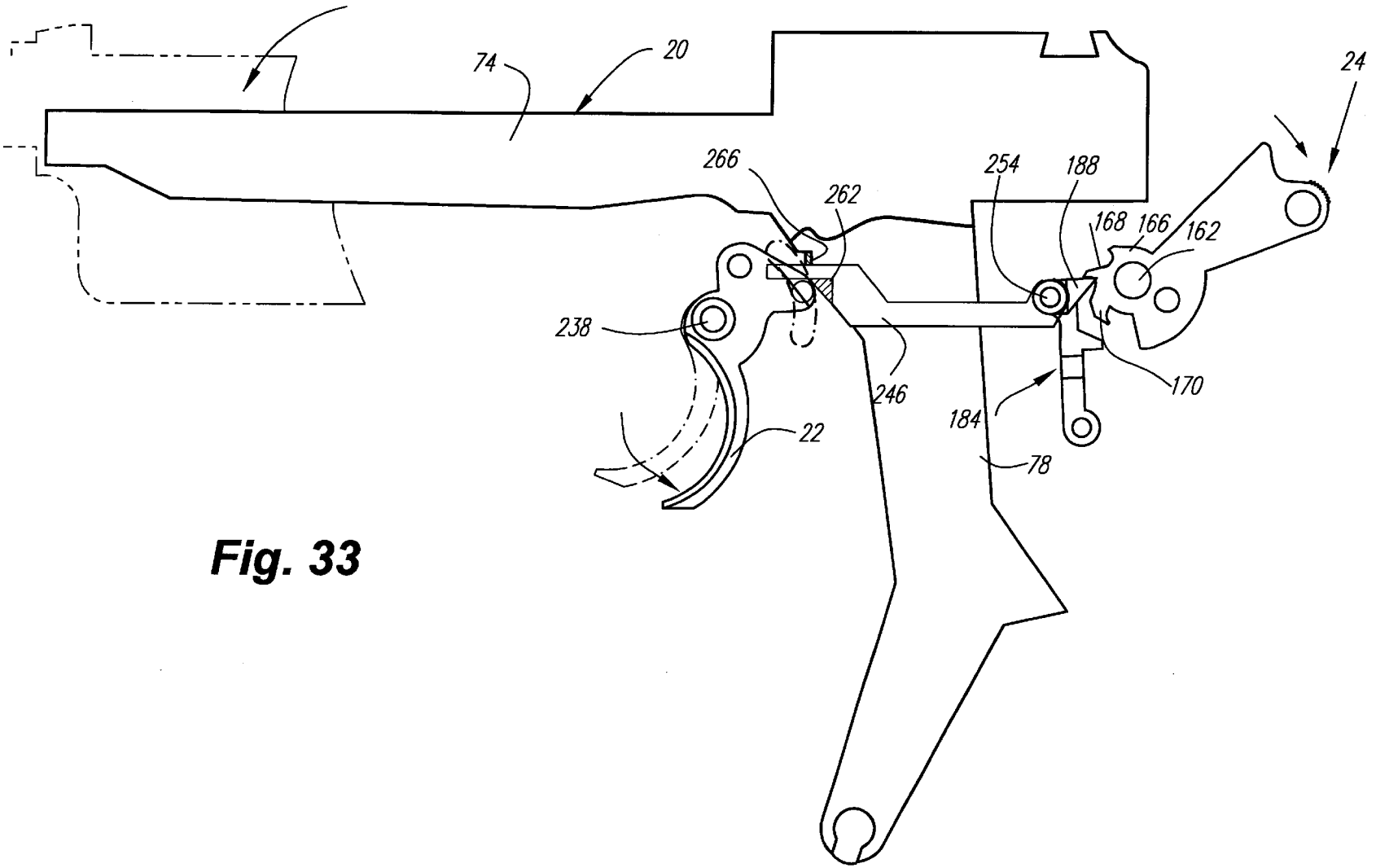

FIGS. 30 and 33 illustrate the firing action in a semi-automatic mode. As the trigger 22 is pulled in the rearward direction, the trigger bar 240 is pulled in a forward direction as the pin 241 moves through an arcuate slot 245 in the frame. As the bar 240 moves forwardly, the lateral generally triangular projection 252 engages the hammer, behind tooth 170 causing the hammer to rotate in a counterclockwise direction as viewed in FIG. 30, against the bias of hammer spring 182. As the hammer rotates in a cocking direction, the spring biased sear ratchet tooth 188 clicks passed the shallow tooth 166 and, as the hammer continues to rotate, rides over the intermediate tooth 168 as well, so that the hammer is fully cocked and momentarily held in place by sear. As the trigger bar tooth 252 disengages from tooth 170 as the latter rotates upwardly away from the tooth 252, the forward edge of sear release block 250 on the trigger bar engages a corresponding release surface 247 on the sear (best seen in FIG. 28), causing the sear to move away from tooth 168 and thereby allowing the hammer spring 182 to drive the hammer 24 forwardly into engagement with the firing pin 192. Note that the axial length of the firing pin is slightly less than the length of the bore in the web portion 82 of the slide. Thus, when the firing pin is engaged by the hammer, it is "thrown" forwardly into engagement with the rear end of the cartridge. This prevents a non-intentional shot being fired when the gun is accidentally dropped with the hammer striking the floor first.

Upon firing of the cartridge, the slide 20 rotates upwardly and away from the barrel as previously described and, as the slide 20 rotates, the back face of the slide engages the hammer, forcing it back in a cocking direction. At the same time, an internal edge 249 of the slide (see FIG. 5) presses downwardly on the vertical extension 248 of the trigger bar so that the trigger bar tooth 252 does not interfere with the re-cocking of the hammer by the slide. This will ensure that the hammer remains cocked (through the spring action of the sear 184), even though the user may not have yet released the trigger. Note, however, that the rearward end of bar 240 is normally biased upwardly by a wire spring 251 mounted in the frame. Note also that the slide 20 automatically fully cocks the hammer 24, i.e., the hammer is rotated through its fill stroke with the ratchet tooth 188 of the sear engaged with the intermediate tooth 168 of the hammer. When the trigger 22 is released, the trigger bar 240 returns to its original position while the hammer remains cocked and ready for the next shot. Because the hammer 24 is in its fully cocked position, only a soft touch on the trigger 22 will cause the sear tooth 188 to be released, liberating the hammer to fire the next shot.

It should also be appreciated that, in this semi-automatic mode, a single shot can be fired either in the manner described above, or by first cocking the hammer manually by simply pressing the hammer rearwardly either to a first cocked position with ratchet tooth 188 engaged with hammer tooth 168, or to a fully cocked position with ratchet tooth engaged with hammer tooth 168. This action presumes the presence of a cartridge C within the chamber. If no cartridge is located in the chamber, slide 20 can be manually rotated rearwardly to feed a cartridge to the chamber as described above, and to simultaneously move the hammer 24 to the fully cocked position.

Figure 32:
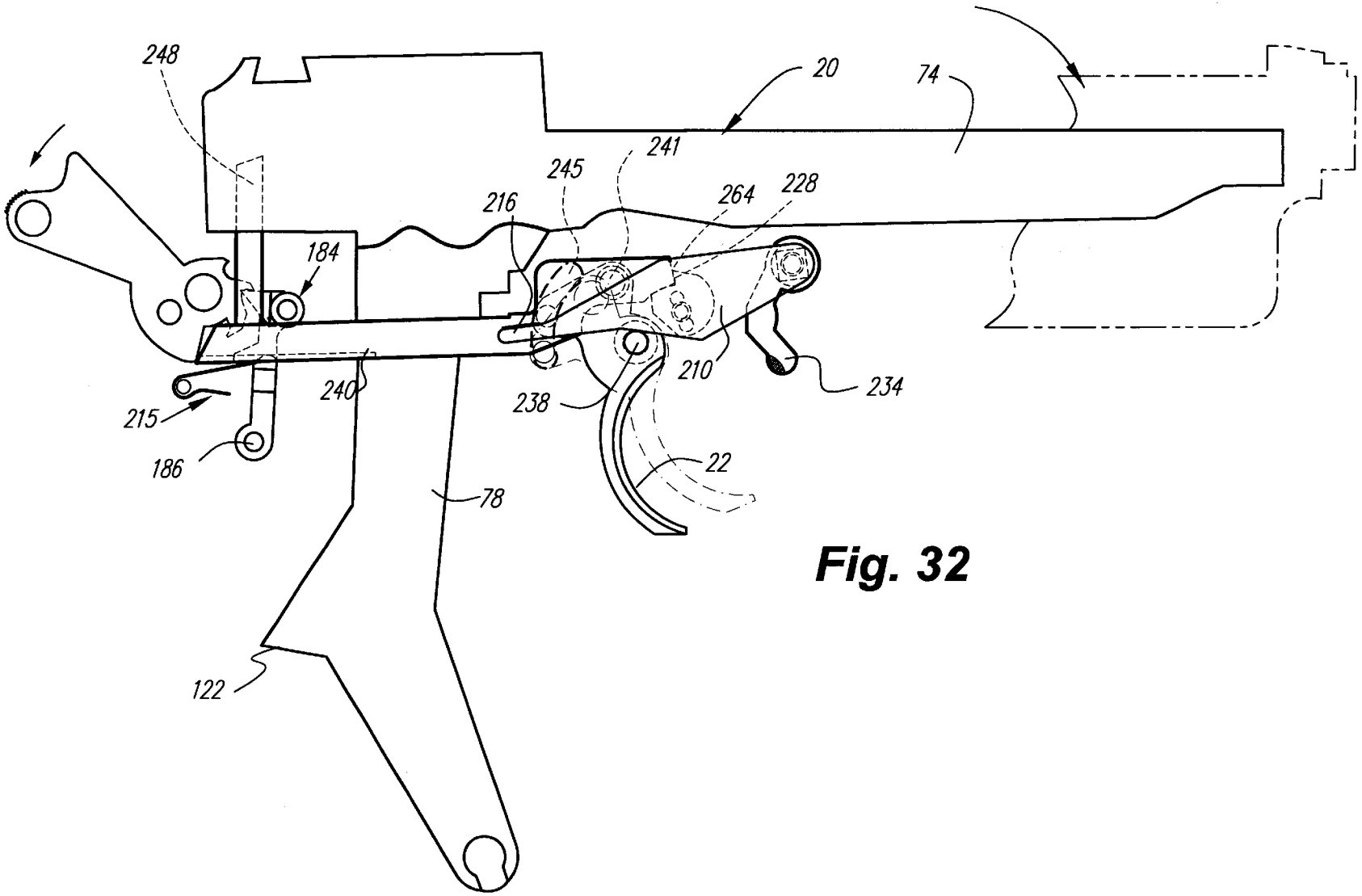

Thus, the user can choose to simply fire a single shot or to fire repeated shots in rapid fashion, since the movement of the slide 20 by gas expansion automatically feeds the next cartridge chamber, and automatically cocks the hammer. The sequence of movements of the trigger 22, trigger bar 240, sear 184 and hammer 24 can be seen in FIGS. 30 and 32 which show the right side of the pistol. Thus, in FIG. 32, the slide 20 is returned to its normal position by recoil spring 156, but the hammer remains cocked due to the engagement of sear ratchet tooth 188 with hammer tooth 168. As the user releases the trigger, the trigger bar 240 moves rearwardly and spring 251 pushes the trigger bar tooth 252 back into engagement with hammer tooth 270, so that the next shot can be fired.

Figure 31:
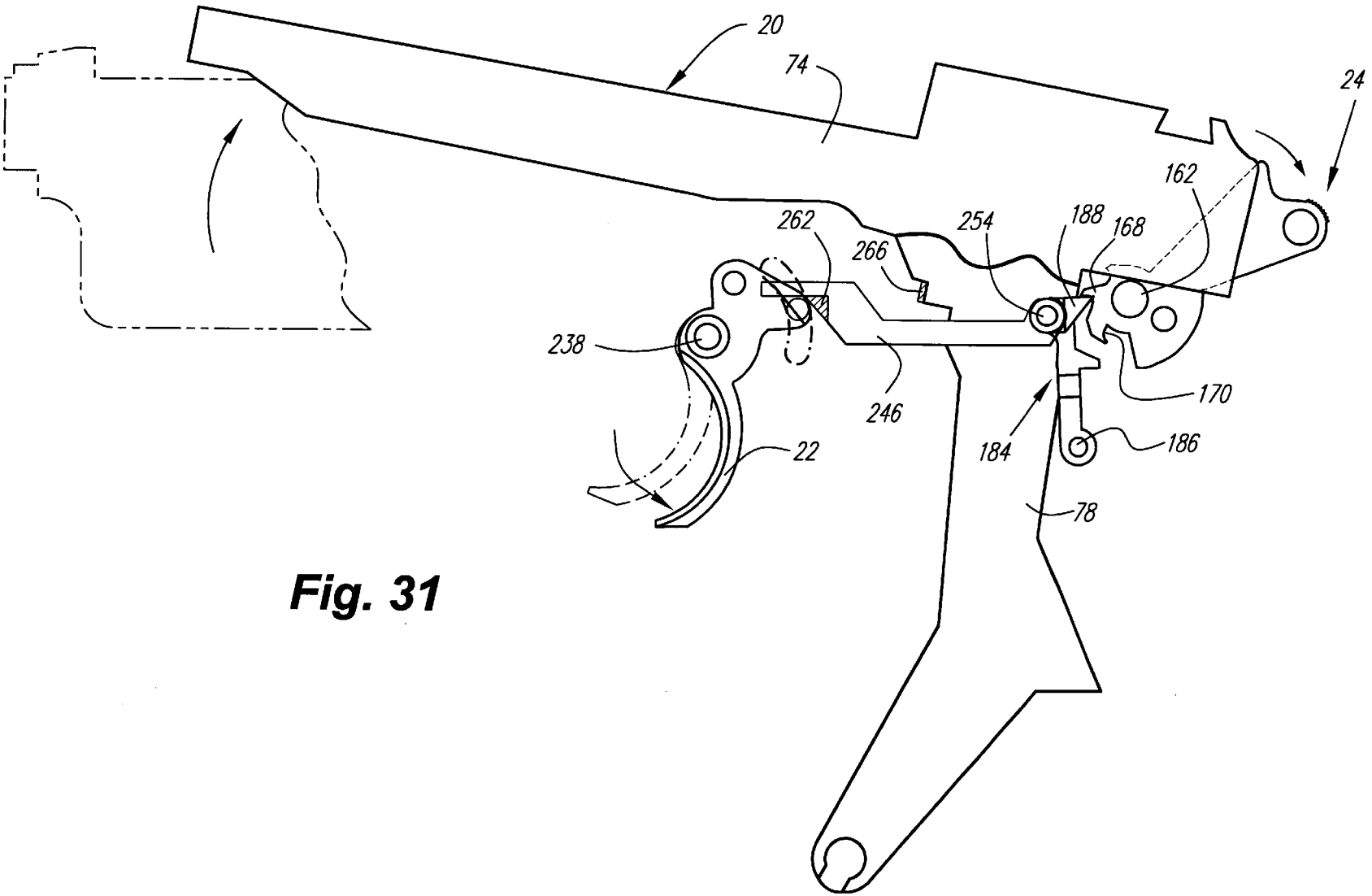

During firing in this semi-automatic mode, the sear actuator bar on the left side of the pistol is essentially inoperative, since the trigger movement is limited so that pin 244 extending from the trigger does not engage the sear bar cam 262 in the semi-automatic mode. That the sear bar has no role to play in the semi-automatic mode is apparent from FIGS. 31 and 33 which correspond to FIGS. 30 and 32 respectively. More specifically, in claim 31, the trigger 22 has been pulled to a firing position, limited by the stop surface 226, and a semi-automatic mode shot has been fired with the slide 20 moving upwardly and away from the barrel. With this movement, the pin 244 on the trigger does not cause any movement of the sear bar 246. In FIG. 33, as the slide 20 closes, the automatic "trigger" surface 266 (see also FIG. 5) does not engage cam 262 because the latter has not been raised by pin 244. Of course, absent any movement of sear bar 246, the sear ratchet tooth 188 retains the hammer in the cocked position.

Automatic Firing Mode

Figure 34:
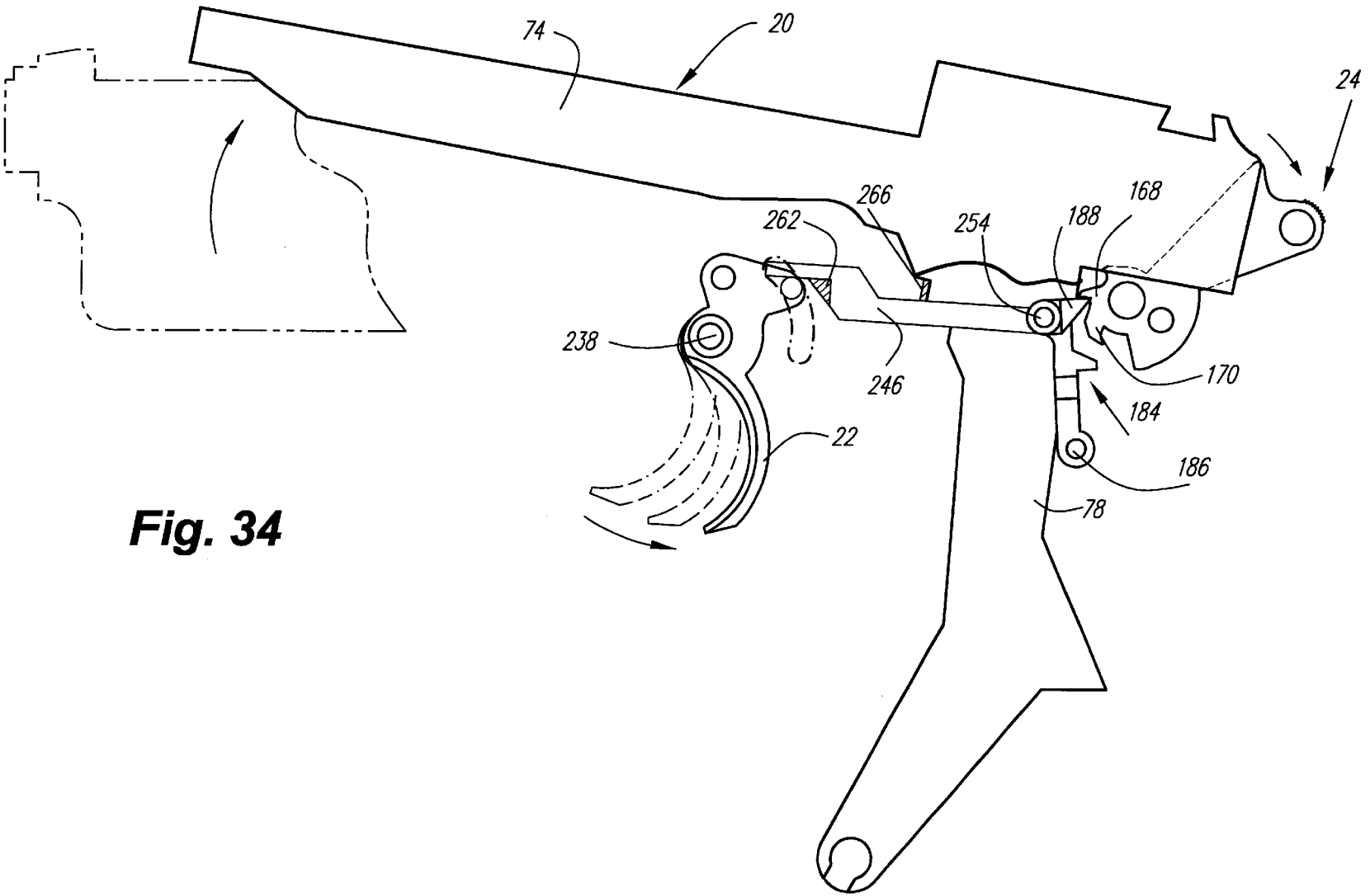
Figure 35:
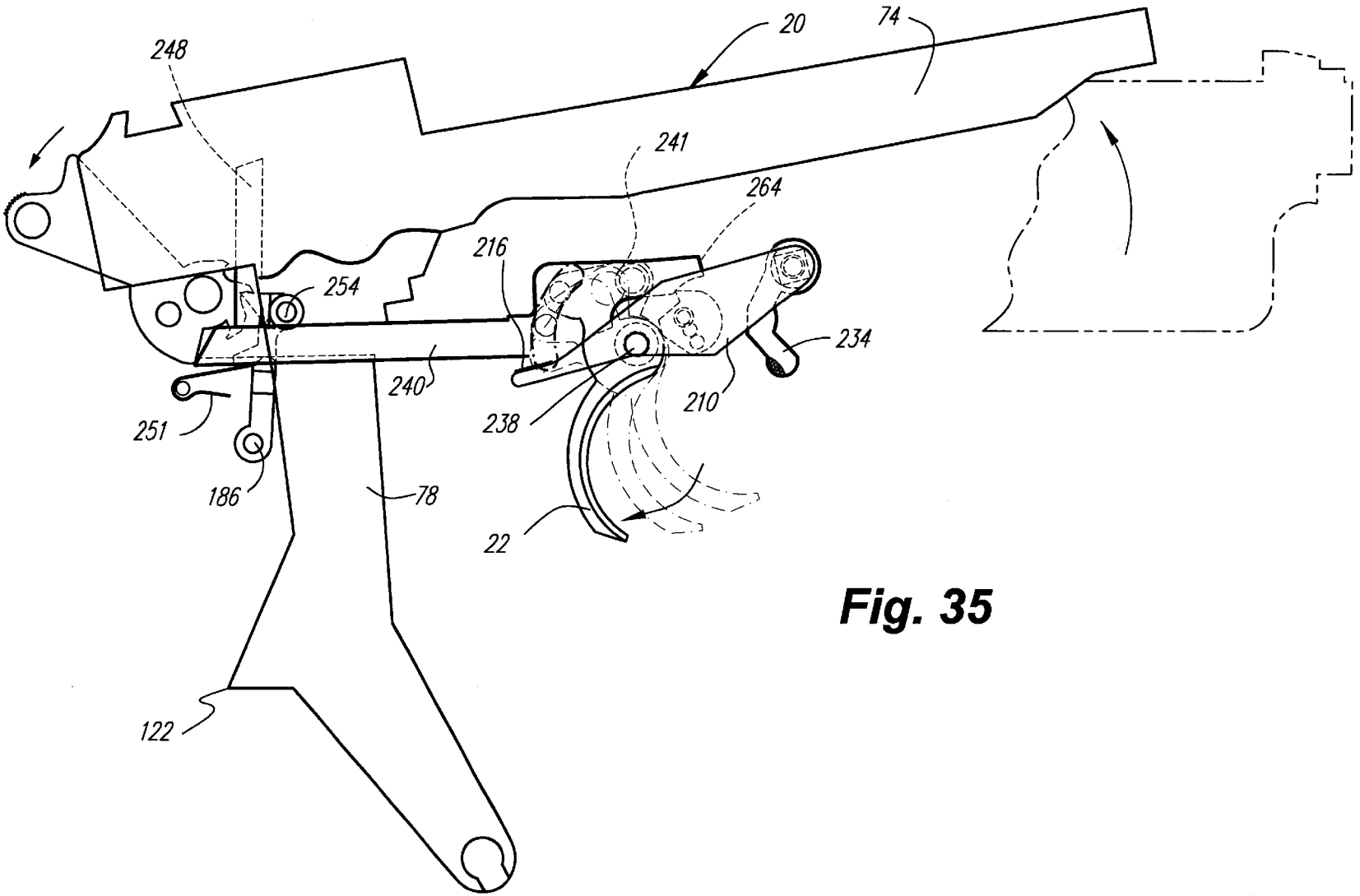

When the safety levers 34 and 210 are moved to automatic firing mode with ball 230 in detent 220, the trigger bar 240 on the right side of the pistol is free to move above and beyond the final stop surface 226 on the inside of the safety lever 210, thus permitting the trigger bar 204 to move through its full stroke. Moreover, as explained below, the trigger bar 240 does not interfere with automatic firing and, in fact, has no role to play in the full automatic firing mode, once the first shot has been fired. With reference to FIG. 35, the trigger is now pulled completely to the rear to initiate automatic firing. The first shot is fired in the same way as described above, with trigger bar 240 cocking the hammer which, in turn, releases the sear ratchet tooth 188, but the trigger is moved further in the rearward direction and held there. Now, as best seen in FIG. 34, the trigger 22 when moved through its full stroke (uninhibited by bar 240) the pin 244 engages the forward end of the sear bar 246 and pivots it upwardly (in a clockwise direction) about pin 254 and the slide is closing after a shot has been fired. Note that the hammer will remain cocked due to the holding action of the sear tooth 188. As the slide 20 closes, "trigger" surface 266 of the slide 20 engages cam 262 on the sear bar 246, moving the sear bar forward, pulling the sear ratchet tooth out of engagement with hammer tooth 168, liberating the hammer which is now moving to fire the next shot. This cycle will be repeated automatically until the trigger is released or until the last cartridge of the magazine has been fired.

Figure 36:
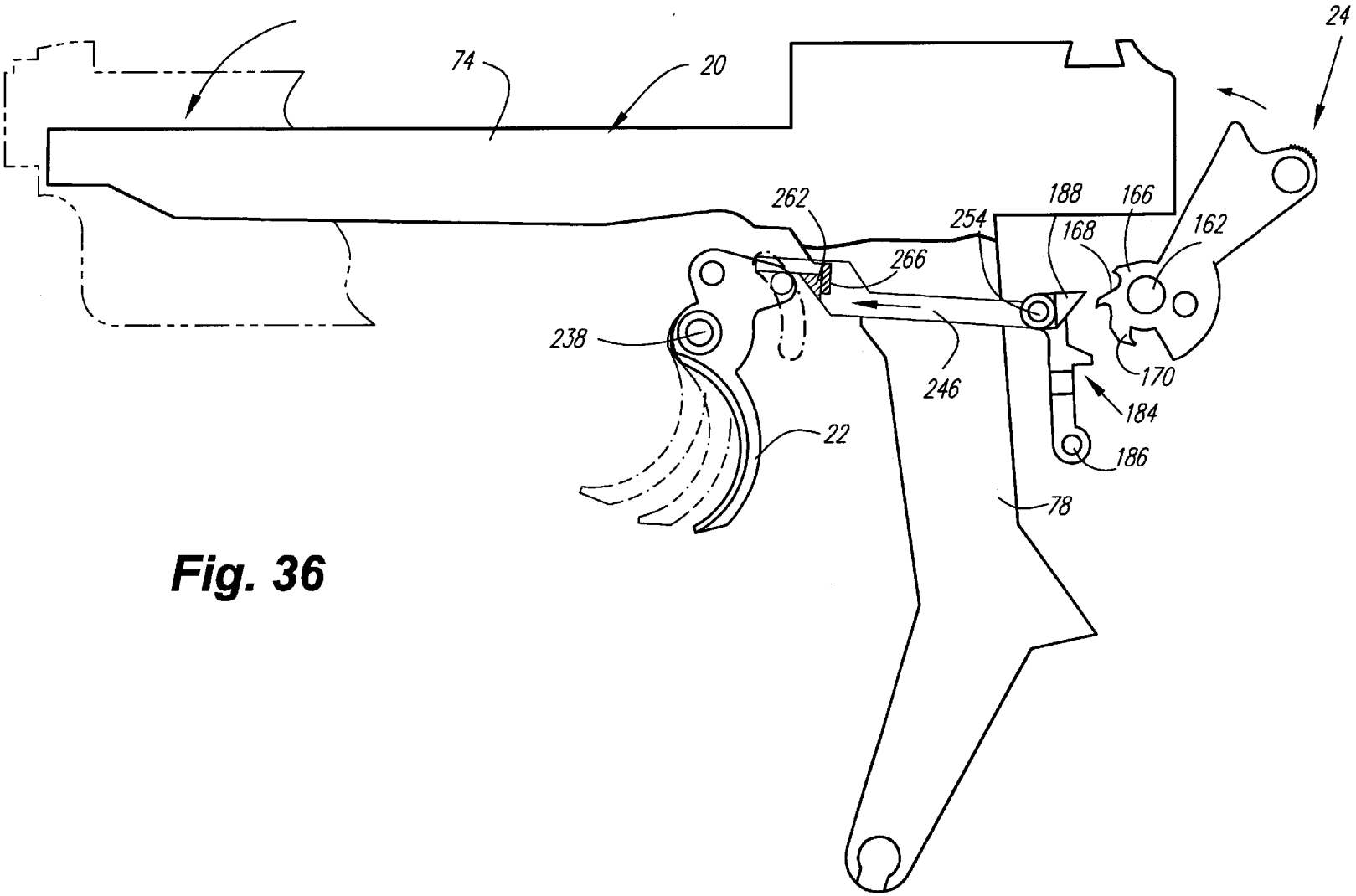
Figure 37:
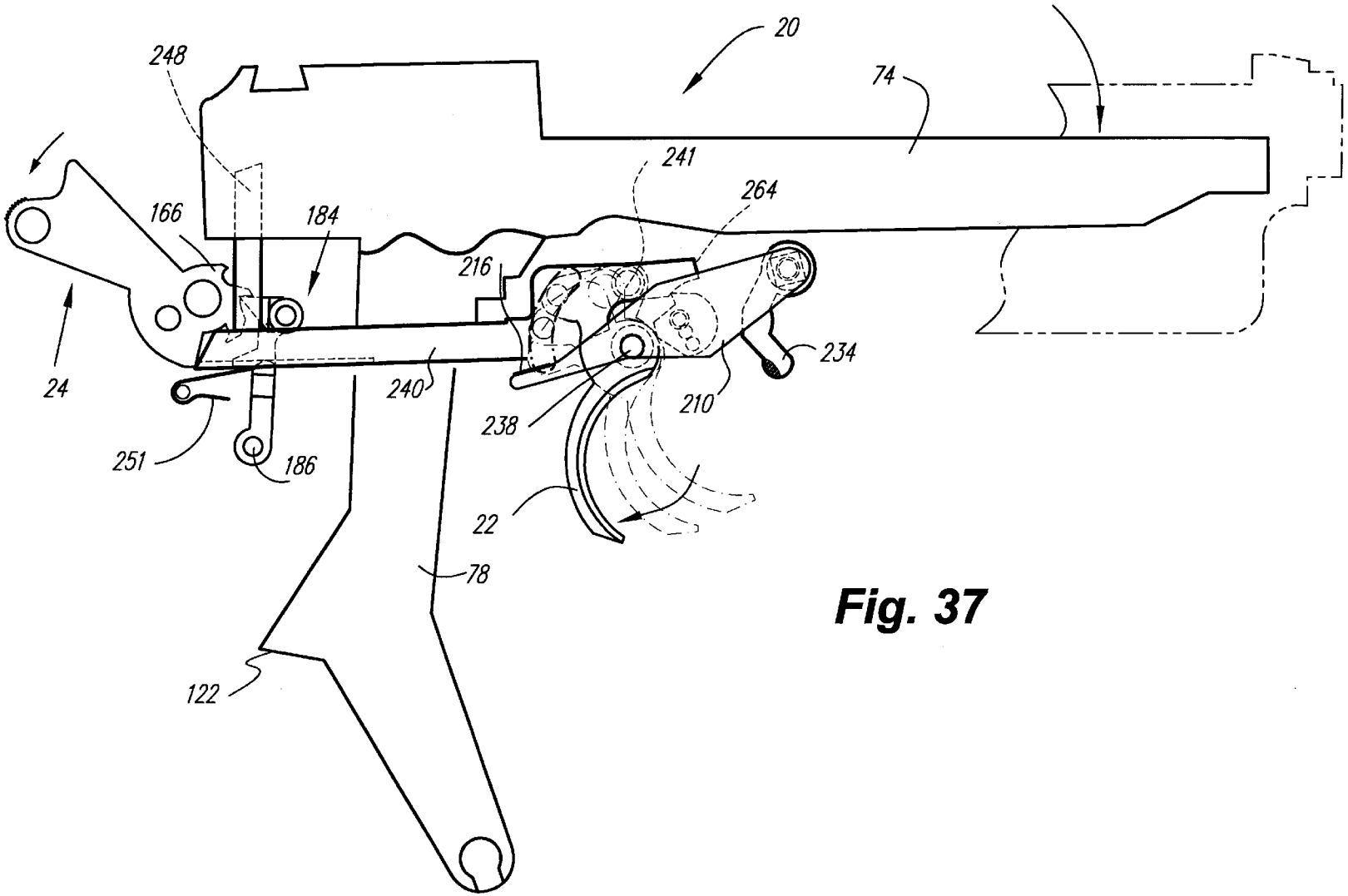

During automatic firing in the automatic mode, the action of the trigger bar 240 is illustrated in FIGS. 35 and 37, which correspond to FIGS. 34 and 36, respectively. Note that the forward edge 264 of the trigger bar 240 is free to move up and over the stop surface 226 on the interior surface of the safety lever 210 so that not only is the trigger bar free to move forward to its fullest extent, but such movement also removes the trigger bar from any interaction with the hammer or the sear mechanism, after the first shot in the automatic mode is fired. Note also that as the slide 20 closes after each shot, trigger bar extension 248 is pressed downwardly by slide surface 240 so that trigger bar tooth 252 does not interfere with the rapid firing and cocking movement of the hammer 24.

Thus, in the full automatic mode, it is the rapid pivoting opening and closing movement of the slide 20 which cocks and recocks the hammer 24, and which releases the hammer 24 via the interaction of the sear cam 262 with the slide surface 266, to continue rapid firing without any action required on the part of the user other than holding the trigger in its rearward most position. The continuous action of slide 20 also "pumps" air in and around the barrel to cool the latter.

Figure 38:
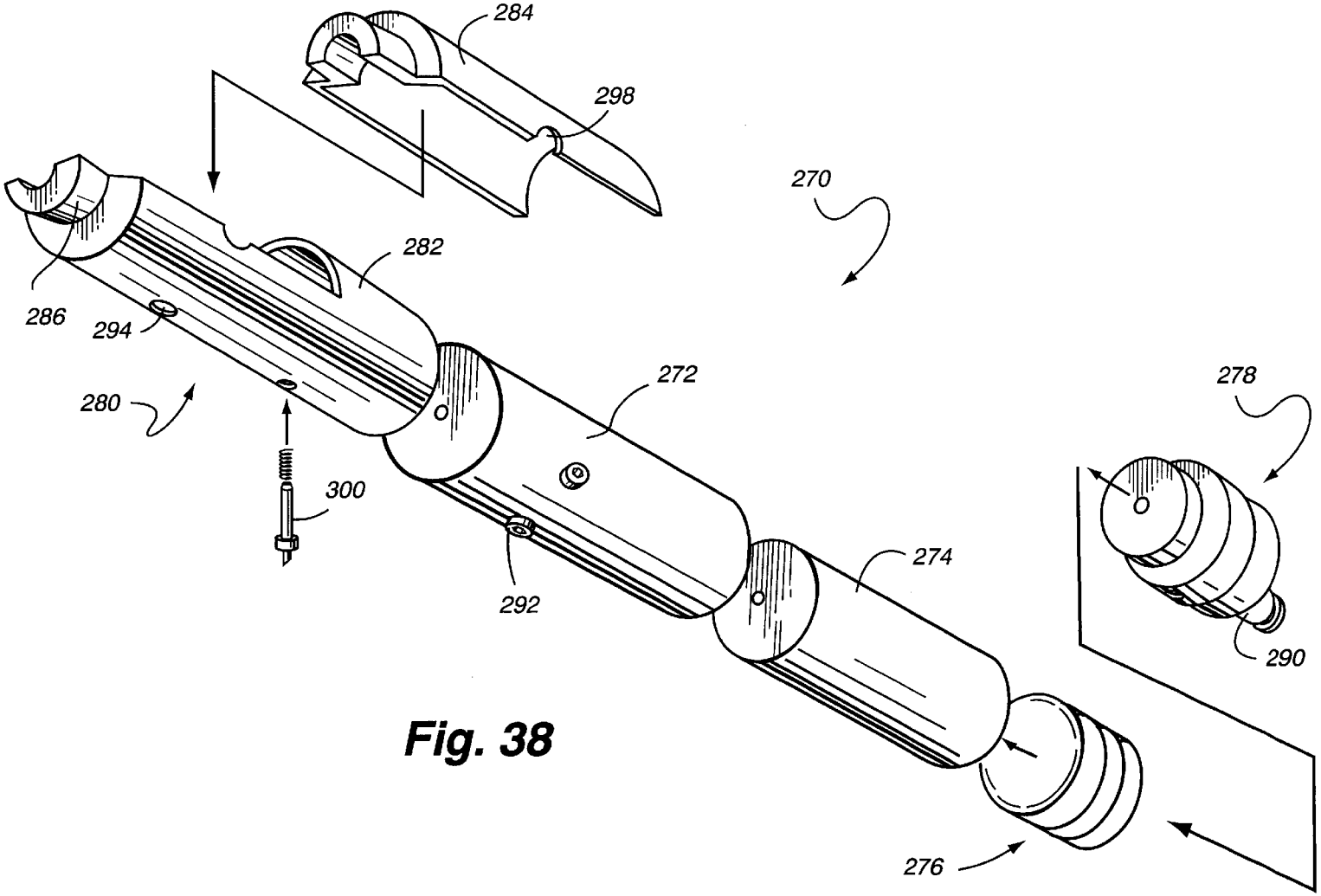
FIG. 38 is an exploded perspective illustrating a laser aiming mechanism in accordance with an alternative embodiment of the invention.
Figure 39:
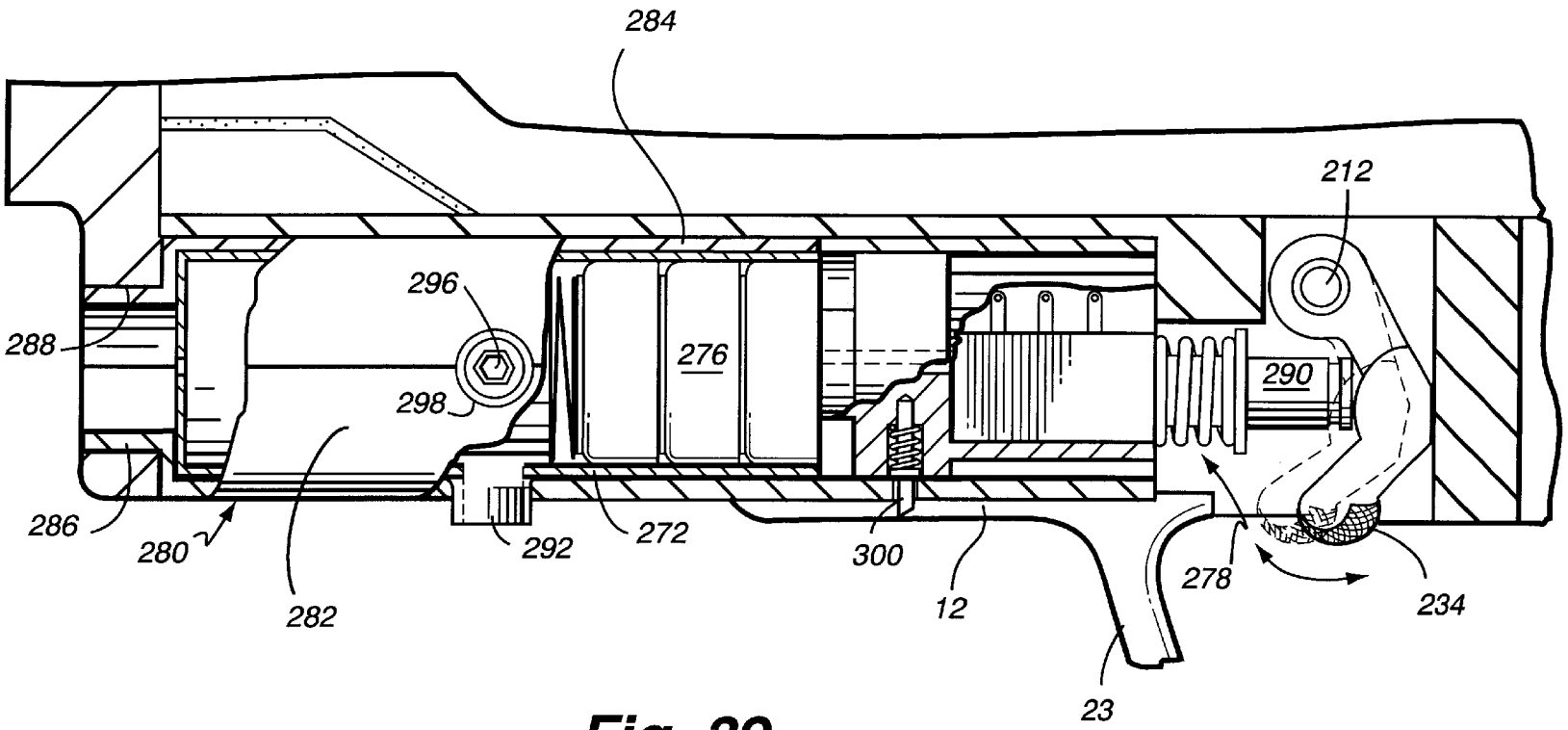
FIG. 39 is a partial side elevation, partly in section, illustrating the laser aiming device of FIG. 38 in place with the pistol frame.

FIG. 38 shows an exploded view of a laser aiming mechanism in accordance with a preferred embodiment of the invention. In this embodiment, the laser aiming device 270 (which may be the same commercial device previously identified) which includes a cylindrical cover 272 housing the laser unit 234, and battery pack 276 and switch 278 is fitted within a split cylindrical casing 280 including a body 282 and cover 284. The unit including elements 270, 272, 274 and 276 are identical to laser device 30. When assembled within the split casing 280, the laser device is fully integrated and substantially fully enclosed within the pistol frame 12 below the barrel 18, with the smaller diameter forward end portion 286 of casing 280 received within a corresponding diameter bore 288 in the depending flange or bushing at the forward end of the pistol frame. A spring loaded switch rod projects from the rear of the unit and engages the crank-like actuator lever 234 shown in FIG. 25, which is rotatable relative to the pivot pin 212. The actuator lever 234 projects into the area enclosed by the trigger guard 23, forward of the trigger 22. The laser can be actuated by pressing the lever 234 forward and deactivated by a second pressing and similar forward action. Because lever 234 rotates freely with respect to pin 212, operation of lever 234 does not affect the safety levers, and vice versa. A vertical adjustment pin 292 is accessible through a hole 294 in the casing, and a horizontal adjustment pin 296 is accessible through a similar hole 298 at the interface of cover 284 and body 282.

A spring loaded blocking pin 300 locks the rear end of the laser assembly to the frame 12. By removing the barrel as described above, the laser unit can be slidably removed from the frame simply by depressing the pin 300.

Figure 40:
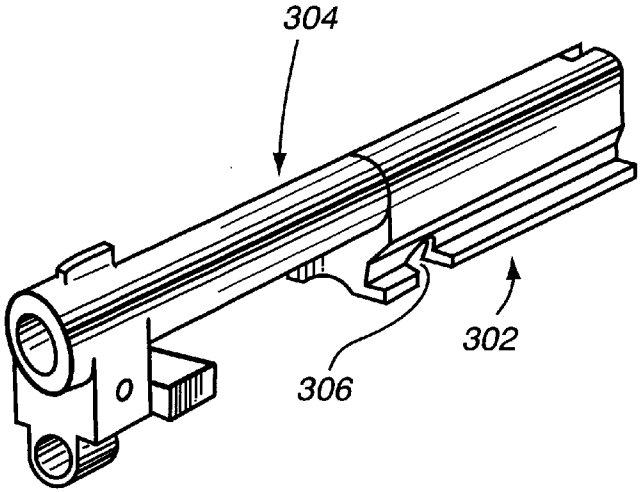
FIG. 40 is a partial perspective illustrating a modified barrel for use with an alternative barrel locking mechanism.
Figure 41:
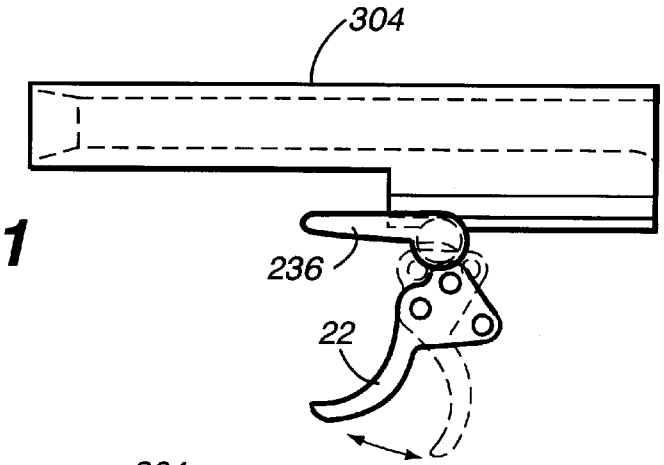
FIG. 41 is a simplified side elevation illustrating the alternative barrel locking lever for use with the barrel of FIG. 40 in a locked position.
Figure 42:
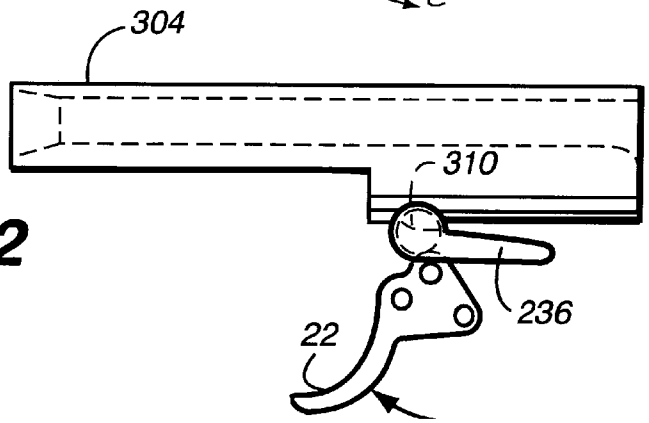
FIG. 42 is a simplified side elevation illustrating the alternative barrel locking lever for use with the barrel of FIG. 40 in a release position.

FIGS. 40–42 illustrate an alternative and preferred barrel lock arrangement which is similar in principal to that which is disclosed in FIGS. 2–4 but relocates the release lever away from the end of the barrel, and arranged the lever to pivot about an axis transverse to the barrel axis. Thus, it can be seen that the keyway 306 on the barrel 304 as shown on FIG. 40 includes a transverse recess 306 which is adapted to align over a similar recess formed in the frame. With reference also to FIG. 25, the locking cylinder 308 includes a flat surface 310 which, when flush with the surface of the frame, permits the barrel to be removed as previously described. Upon insertion of the barrel, the lever 236 is rotated to cause the round portion of the cylinder 308 to rotate up into the recess 306, thereby precluding any axial movement of the barrel. On the other hand, with the lever 236 in the release position (FIGS. 25 and 42) the cylinder 308 prevents firing movement of the trigger. When the barrel is locked (FIG. 41), the trigger is uninhibited by the cylinder 308. To ensure ambidextrous operation, the lever 236 may be duplicated on the opposite side of the pin, thereby providing both left and right handed access to the barrel locking device. It will be appreciated that because lever 236 rotates forwardly to lock the barrel in place, it does not interfere with the movement of the safety levers 34 and 210.

It is also desirable to provide an insert 312 (polypropylene, for example) at the forward end of the frame which is impacted by the slide 20 as it returns from its recoil position to its normal position under the influence of recoil spring 156. The insert 312 not only serves to provide some cushioning for the slide, but also serves to reduce the noise which would otherwise occur by the metal-to-metal contact as the slide returns to its normal closed position. A similar insert 314 may be provided at the rear of the frame, to cushion the impact between the slide 20 and the frame when the slide is rotated to its full open position.

Various modifications and additions are within the scope of this invention. For example, the tension of the recoil spring 156 may be made adjustable by any suitable mechanism in order to accommodate different caliber ammunition. A hydraulic or other suitable dampening device may be employed to control the movement of the slide 20 and thus vary the rate of firing.

It will be appreciated that extended clips or magazines can be used (holding, e.g., 30 rounds), and that a known adjustment mechanism can be incorporated into the pistol to control the number of cartridges fired in the automatic mode.

The fixed sights 26, 28 could also be adjustable. In addition, it might be desirable to extend the barrel length, and to change the angle at 19' to avoid liberation of all of the combustion gases at the same time, thereby reducing muzzle blast.

On the whole, the pistol described herein has lower production costs due to the reduced number of moving parts and due to the pivoting slide mechanism which eliminates the need for high precision milling operations which are usually necessary for slide and frame construction.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A slide action pistol including a frame; a barrel supported on said frame and having a bore on an axis of the barrel; a handgrip portion of the frame provided with a cavity therein for receiving a magazine; a firing assembly including a trigger, hammer and firing pin arranged in operative relationship; and, a slide having one end engaged with the barrel and an opposite end pivotally connected to said handgrip portion, said slide arranged to pivot upwardly and rearwardly when the pistol is fired.

2. The slide action pistol of claim 1 and further comprising a laser aiming device at least partially enclosed within said frame below said barrel.

3. The slide action pistol of claim 2 including a button actuator operatively connected to said laser aiming device, said button actuator located within a guard ring surrounding said trigger.

4. The slide action pistol of claim 1 including a locking assembly for said barrel, said locking assembly comprising a rotatable lock operatively connected to a barrel release lever, said rotatable lock freeing the barrel and locking the trigger in one position, and freeing the trigger and locking the barrel in another position.

5. The slide action pistol of claim 4 wherein said rotatable lock has an axis of rotation parallel to said bore.

6. The slide action pistol of claim 4 wherein said rotatable lock has an axis of rotation perpendicular to said bore.

7. The slide action pistol of claim 1 including an empty cartridge ejector mounted on the slide, said ejector extending partially out of said slide when a cartridge is chambered within the barrel.

8. The slide action pistol of claim 1 wherein said bore in said barrel expands in diameter in a region adjacent a forward edge of the barrel.

9. The slide action pistol of claim 1 wherein a field stripping lever is pivotally mounted to the handgrip portion of the frame, said field stripping lever incorporating a transverse pin by which said slide is pivotally connected to the handgrip portion of said frame.

10. The slide action pistol of claim 9 wherein said field stripping lever is movable between locked and unlocked positions, and wherein said field stripping lever is mounted adjacent the magazine such that the lever cannot be moved to the unlocked position without first removing the magazine.

11. The slide action pistol of claim 1 wherein said barrel and said slide are removable from said frame independently of each other.

12. The slide action pistol of claim 1 wherein said slide includes a pair of forward extending sides locatable on opposite sides of said barrel, and a pair of rearward sides locatable on opposite sides of the grip portion of the frame.

13. The slide action pistol of claim 12 wherein said slide includes a yoke region where said forward and rearward sides join, said yoke including a body portion having an axial bore for receiving the firing pin, and a groove along a top surface thereof, pivotally mounting a cartridge extractor.

14. The slide action pistol of claim 13 wherein said extractor is spring biased at one end to a position where a forward end of the ejector is substantially flush with the frame when no cartridge is chambered; but stands proud of the frame when a cartridge is chambered.

15. The slide action pistol of claim 1 and further comprising a recoil spring biasing said slide to a closed, forward position, said recoil spring telescoped over a hollow recoil spring guide.

16. The slide action pistol of claim 12 and further comprising a recoil spring biasing said slide to a closed, forward position, said recoil spring telescoped over a hollow recoil spring guide.

17. The slide action pistol of claim 1 and further including a hammer spring biasing said hammer toward a firing position, said hammer spring telescoped over a hammer spring guide slidably received within said hollow recoil spring guide.

18. The slide action pistol of claim 15 wherein said recoil spring is located within the grip portion of the frame.

19. The slide action pistol of claim 16 wherein said recoil spring includes a cap having laterally extending projections engaged by said rearward sides of said slide.

20. The slide action pistol of claim 1 including non-metal inserts on said frame to cushion said slide at extreme limits of motion of said slide.

21. A slide action pistol including a frame; a barrel supported on said frame and having a bore on an axis of the barrel; a handgrip portion of the frame provided with a cavity therein for receiving a magazine; a firing assembly including a trigger, hammer and firing pin arranged in operative relationship; a slide having one end engaged with the barrel and an opposite end pivotally connected to said handgrip portion, said slide arranged to pivot upwardly and rearwardly when the pistol is fired; and means for firing said pistol, selectively, in semi-automatic or automatic modes.

22. The slide action pistol of claim 21 and further comprising a laser aiming device at least partially enclosed within said frame below said barrel.

23. The slide action pistol of claim 21 including a locking assembly for said barrel, said locking assembly comprising a rotatable lock operatively connected to a barrel release lever, said rotatable lock freeing the barrel and locking the trigger in one position, and freeing the trigger and locking the barrel in another position.

24. The slide action pistol of claim 21 including an empty cartridge extractor mounted on the slide, said extractor extending partially out of said slide when a cartridge is chambered within the barrel.

25. A The slide action pistol of claim 21 wherein a field stripping lever is pivotally mounted to the handgrip portion of the frame, said field stripping lever incorporating a transverse pin by which said slide is pivotally connected to the handgrip portion of said frame.

26. The slide action pistol of claim 21 wherein said field stripping lever is movable between locked and unlocked positions, and wherein said field stripping lever is mounted adjacent the magazine such that the lever cannot be moved to the unlocked position without first removing the magazine.

27. The slide action pistol of claim 21 and including a safety lever comprising two operatively connected lever arms extending along opposite sides of said pistol, said lever arm connected by a pivot pin extending transversely through said frame.

28. The slide action pistol of claim 27 wherein said lever arms are simultaneously movable between full safety, semi-automatic and full automatic positions.

29. The slide action pistol of claim 28 wherein one of said lever arms is formed with detents for each of said positions, said detents cooperating with a spring loaded ball on said frame.

30. The slide action pistol of claim 29 and further comprising a trigger bar operatively connected between the hammer and the trigger, and wherein said one of said lever arms is formed with stop surfaces engageable with a forward end of said trigger bar, said stop surfaces corresponding to said full safety and semiautomatic positions of said lever arms.

31. The slide action pistol of claim 1 and further comprising a laser aiming device substantially fully enclosed within said frame below said barrel.

32. The slide action pistol of claim 21 and further comprising a laser aiming device substantially fully enclosed within said frame below said barrel.

33. The slide action pistol of claim 1 wherein said bore is expanded by a taper at the forward end of the barrel.

* * * * *